US010724782B2

(12) United States Patent
Lee et al.

(10) Patent No.: US 10,724,782 B2
(45) Date of Patent: Jul. 28, 2020

(54) REFRIGERATOR

(71) Applicant: Samsung Electronics Co., Ltd., Suwon-si (KR)

(72) Inventors: Jee Hoon Lee, Goyang-si (KR); Sung Wook Kang, Seoul (KR); Tae In Eom, Hwaseong-si (KR); Yong Soo Kyong, Seoul (KR); Yury Telegin, Suwon-si (KR); Ivanov Igor, Suwon-si (KR); Jea Won Lee, Hwaseong-si (KR); Kyung Han Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 357 days.

(21) Appl. No.: 15/039,909

(22) PCT Filed: Nov. 26, 2014

(86) PCT No.: PCT/KR2014/011445
§ 371 (c)(1),
(2) Date: May 27, 2016

(87) PCT Pub. No.: WO2015/080477
PCT Pub. Date: Jun. 4, 2015

(65) Prior Publication Data

US 2017/0003067 A1 Jan. 5, 2017

(30) Foreign Application Priority Data

Nov. 27, 2013 (KR) ..... 10-2013-0145018

(51) Int. Cl.
*F25D 23/02* (2006.01)
*E05D 5/04* (2006.01)
(Continued)

(52) U.S. Cl.
CPC ..... *F25D 23/028* (2013.01); *E05D 5/04* (2013.01); *E05D 7/081* (2013.01); *E05D 7/12* (2013.01);
(Continued)

(58) Field of Classification Search
CPC ..... F25D 23/028; F25D 2323/024; E05D 5/0276; E05D 5/046; E05D 7/081;
(Continued)

(56) References Cited

U.S. PATENT DOCUMENTS 2,211,581 A * 8/1940 Ross ..... E05D 3/02 16/364
4,170,391 A 10/1979 Bottger
(Continued)

FOREIGN PATENT DOCUMENTS

CA 2753949 A1 * 4/2012 ..... F25D 23/028
CN 1213766 4/1999
(Continued)

OTHER PUBLICATIONS

Chinese Office Action dated Feb. 24, 2018 in Chinese Patent Application No. 201480063890.9.
(Continued)

*Primary Examiner* — Hiwot E Tefera
*Assistant Examiner* — Ryan A Doyle
(74) *Attorney, Agent, or Firm* — Staas & Halsey LLP

(57) ABSTRACT

Disclosed herein is a refrigerator that has an improved structure to facilitate assembling of a door and a main body which are separable from each other. The refrigerator includes a main body that forms an exterior appearance, a storage compartment that is provided inside the main body, a door that is rotatably coupled to the main body so as to open and close an open front surface of the storage compartment, and a hinge bracket that connects the main body
(Continued)

and the door. Here, the hinge bracket includes a first bracket that is coupled to the main body and a second bracket that is coupled to the door and detachably coupled to the first bracket.

11 Claims, 18 Drawing Sheets

(51) Int. Cl.
*E05D 7/12* (2006.01)
*E05D 7/081* (2006.01)

(52) U.S. Cl.
CPC ..... *E05D 2007/128* (2013.01); *E05Y 2900/31* (2013.01); *F25D 2323/024* (2013.01); *Y10T 16/535* (2015.01)

(58) Field of Classification Search
CPC ..... E05D 7/10; E05D 7/1005; E05D 7/1044; E05D 7/12; E05D 7/123; E05D 7/125; E05D 15/507; E05D 2007/126; E05D 2007/128; E05D 2007/1094; E05Y 2900/31; E05Y 2600/626
See application file for complete search history.

(56) References Cited

U.S. PATENT DOCUMENTS 4,407,044 A * 10/1983 Iseki ..... E05D 7/04 16/237
4,536,904 A * 8/1985 Whitehead ..... A47C 19/005 248/222.11
4,932,729 A * 6/1990 Thompson ..... A47B 91/002 16/19
5,193,308 A * 3/1993 Davidian ..... E05D 5/023 16/257
5,361,455 A * 11/1994 Kiefer ..... E05D 3/022 16/235
5,408,725 A 4/1995 Wolanin
5,870,801 A * 2/1999 Kim ..... E05D 7/12 16/382
5,960,518 A * 10/1999 Jeong ..... E05D 7/123 16/257
6,030,064 A * 2/2000 Kim ..... E05D 7/0423 16/271
6,085,385 A * 7/2000 Joo ..... E05D 7/12 16/268
6,523,225 B1 * 2/2003 Pecar ..... E05D 7/0407 16/242
2005/0212392 A1 * 9/2005 Jung ..... E05D 11/1064 312/405
2010/0033067 A1 * 2/2010 Kim ..... F25D 23/028 312/236
2012/0032572 A1 2/2012 Lee

FOREIGN PATENT DOCUMENTS

DE 3630234 A1 * 3/1988 ..... E05D 5/023
DE 10 2010 039 743 A1 3/2012
DE 102010039743 A1 * 3/2012 ..... F25D 23/028
EP 2 420 775 A2 2/2012
EP 2 420 775 A3 2/2012
EP 2418443 A2 * 2/2012 ..... E05D 7/0027
JP 2004293913 A * 10/2004
KR 10-0200797 6/1999
KR 20-0202532 11/2000
KR 10-2010-0019616 2/2010
KR 10-1164823 7/2012
KR 10-2013-0021670 3/2013
WO WO-2009043696 A1 * 4/2009 ..... E05D 5/065

OTHER PUBLICATIONS

Extended European Search Report dated Jun. 28, 2017 from European Patent Application No. 14865585, 14 pages.
International Search Report dated Mar. 17, 2015 from International Patent Application No. PCT/KR2014/011445, 3 pages.
European Communication dated Jan. 2, 2019 in European Patent Application No. 14865585.5.
Chinese Notice of Allowance dated Sep. 26, 2018 in Chinese Patent Application No. 201480063890.9.
European Office Action dated Mar. 31, 2020 in European Patent Application No. 14865585.5.

* cited by examiner

[Fig. 1]
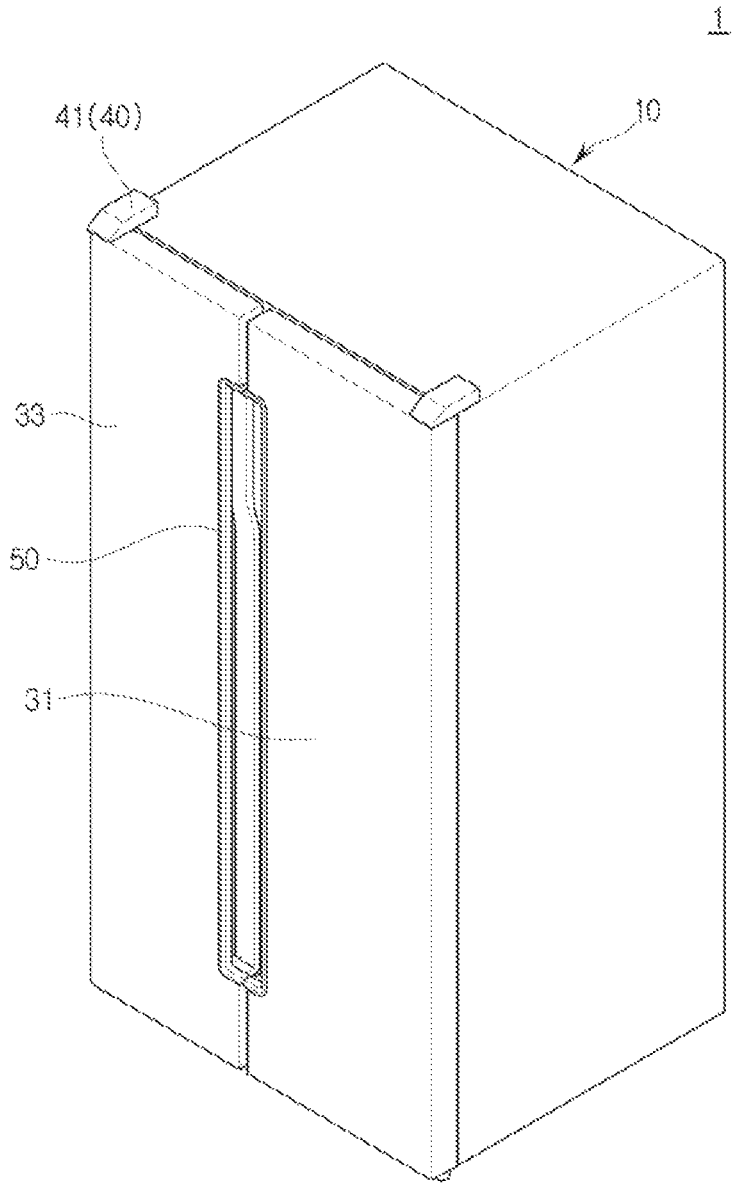

[Fig. 2]
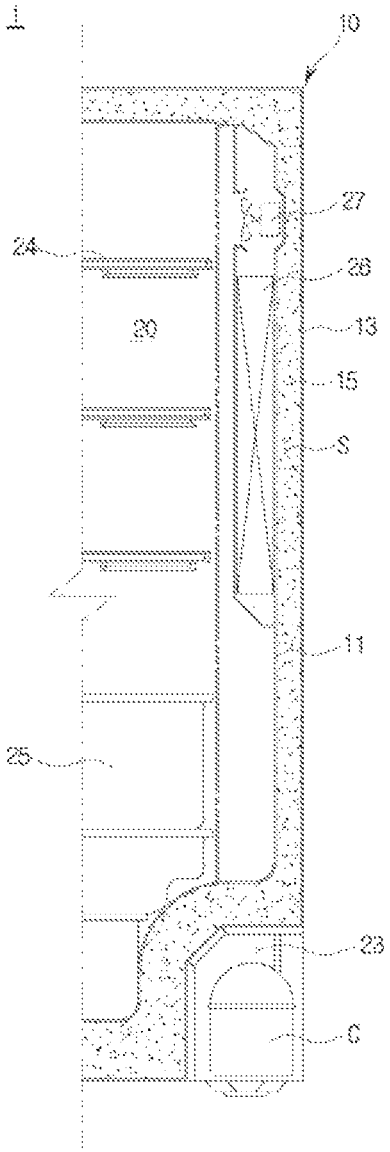

[Fig. 3]
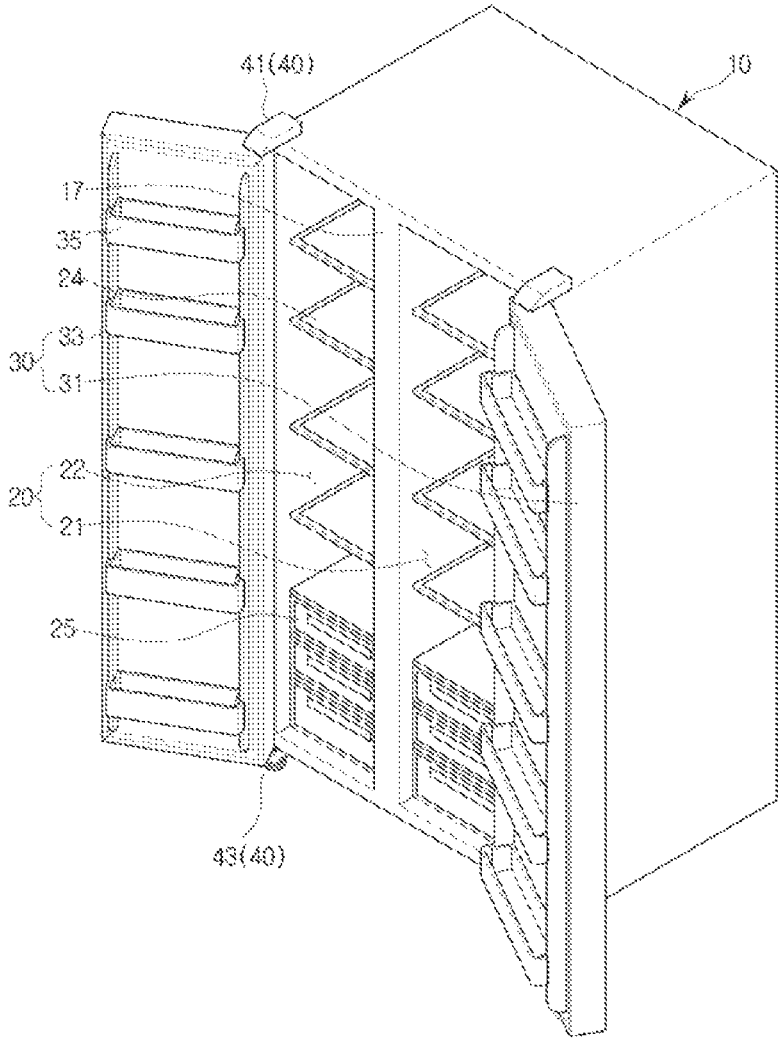

[Fig. 4]
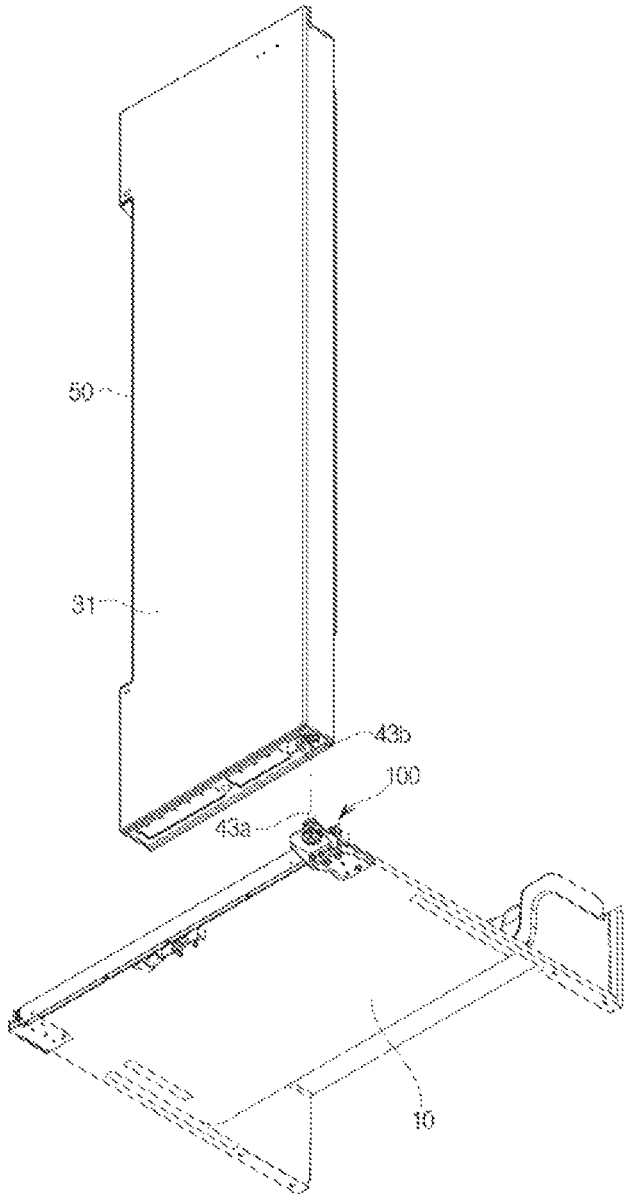

[Fig. 5]
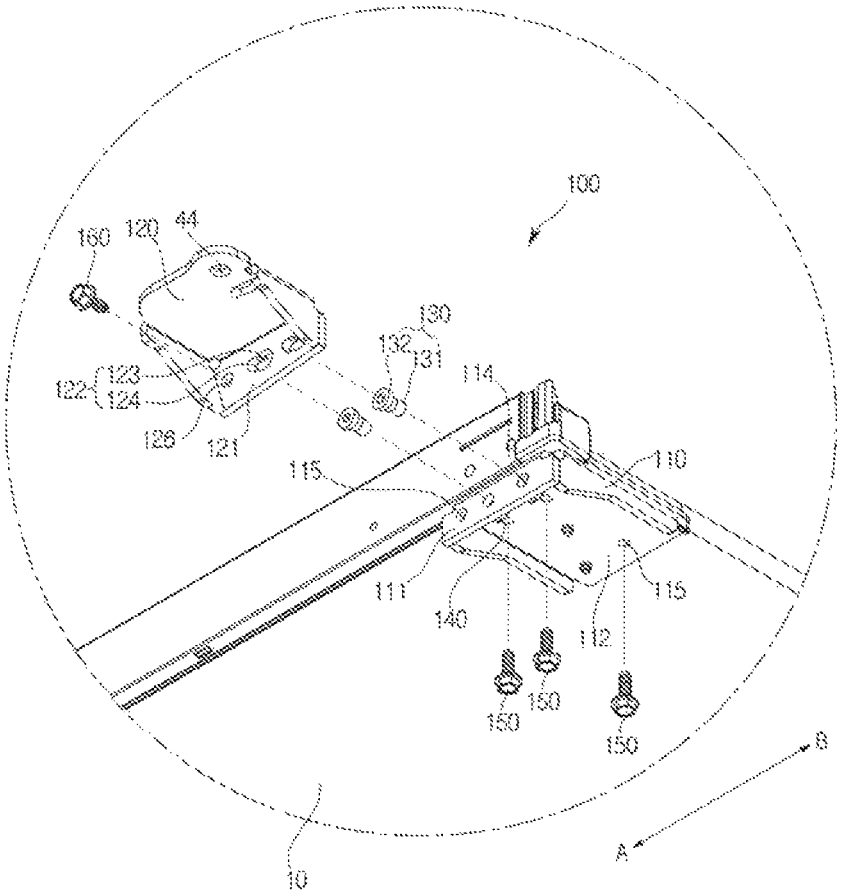

[Fig. 6]
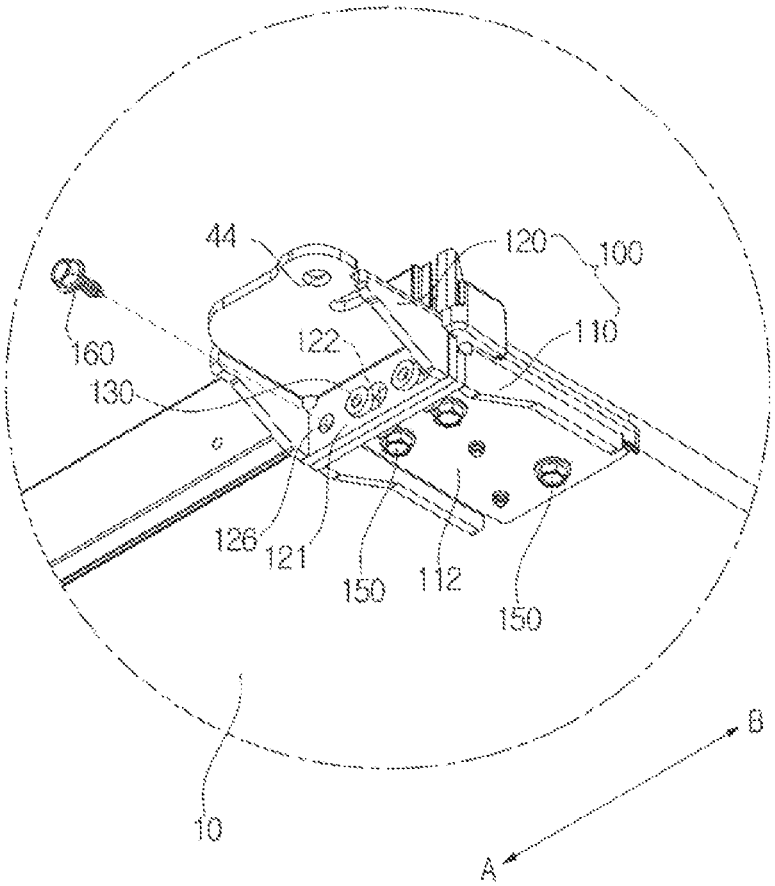

[Fig. 7]
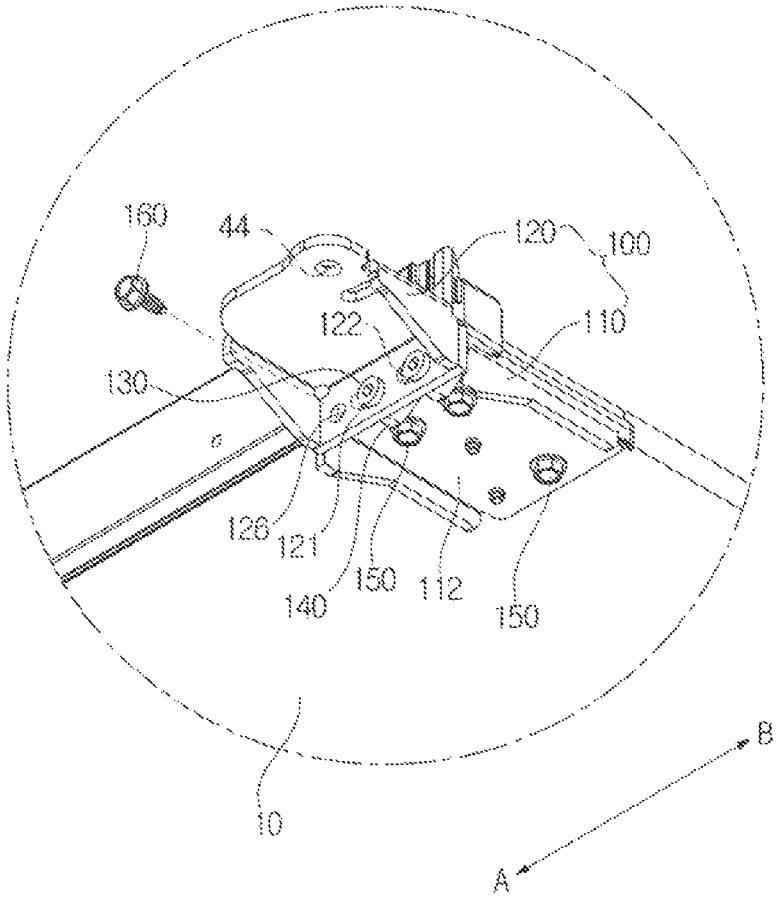

[Fig. 8]
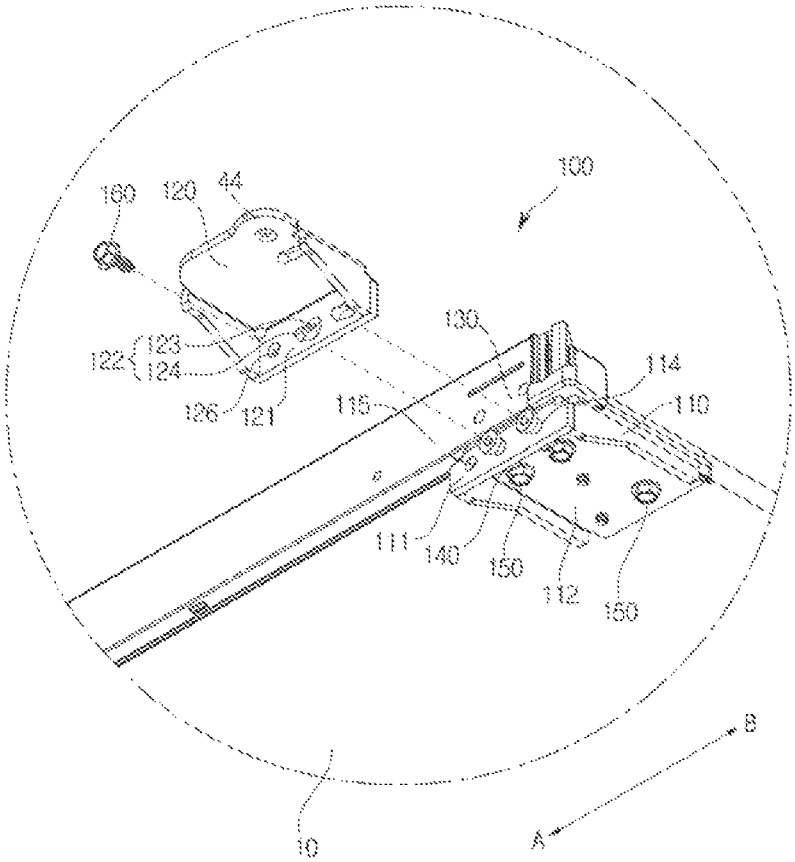

[Fig. 9]
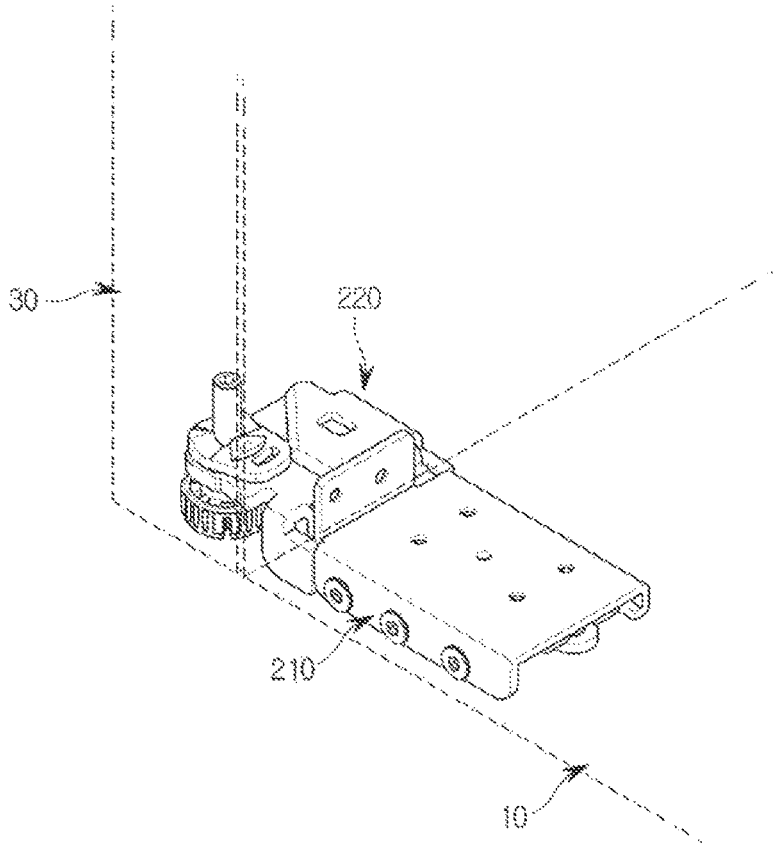
[Fig. 10]
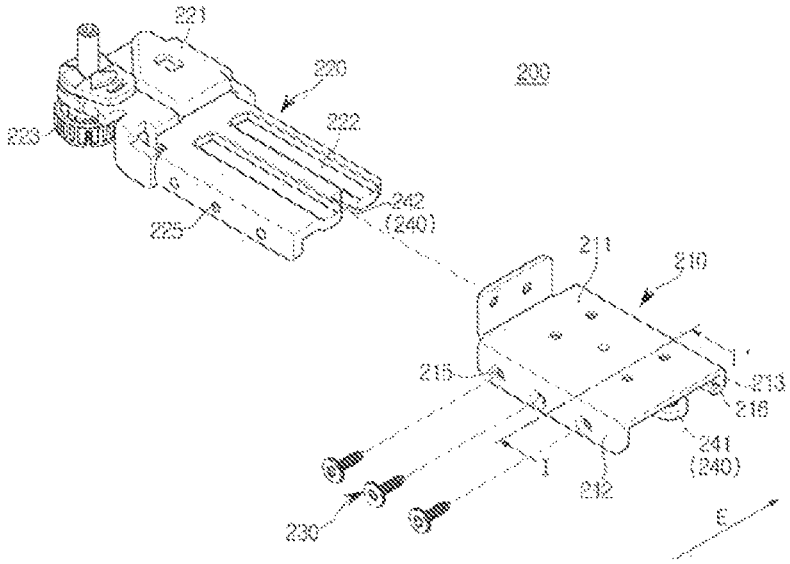

[Fig. 11a]
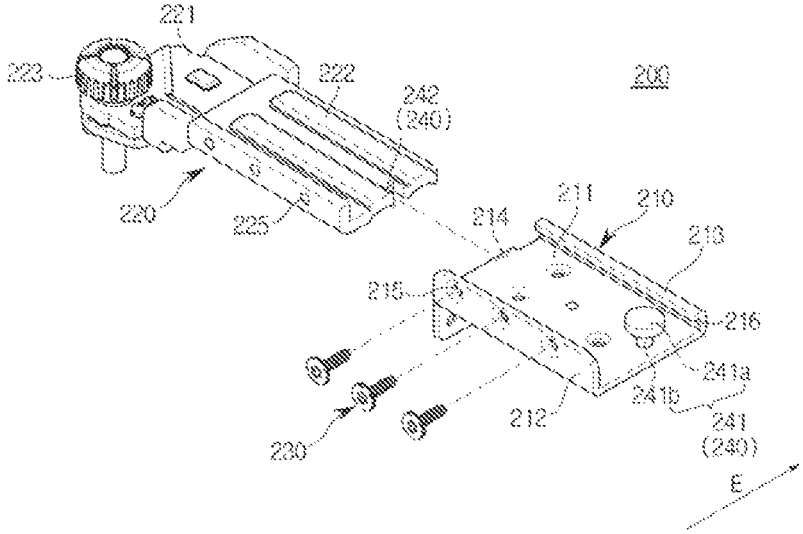
[Fig. 11b]
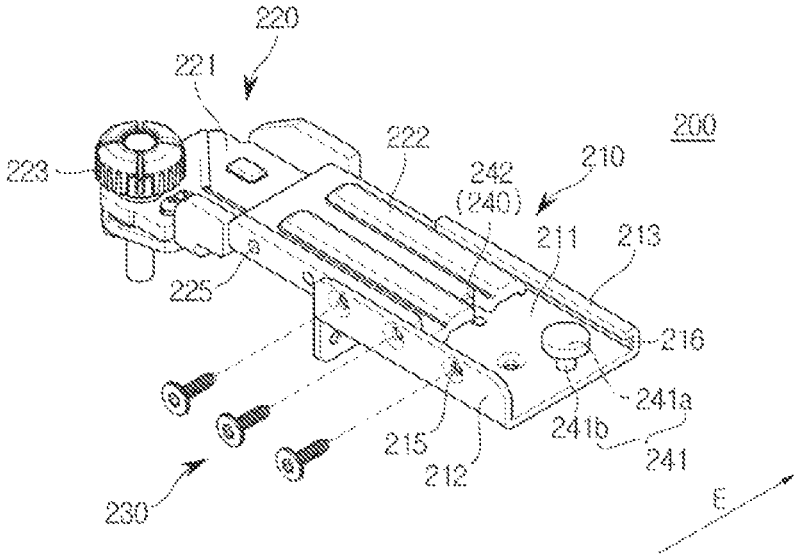

[Fig. 11c]
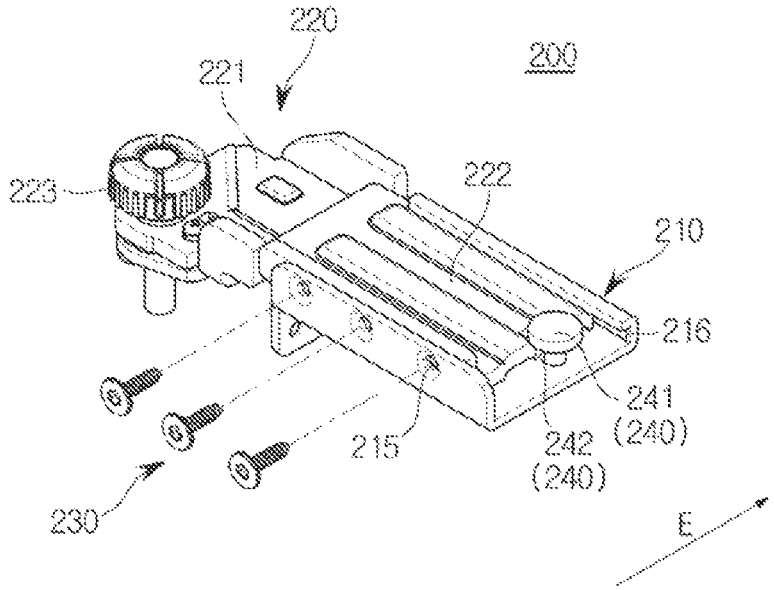
[Fig. 11d]
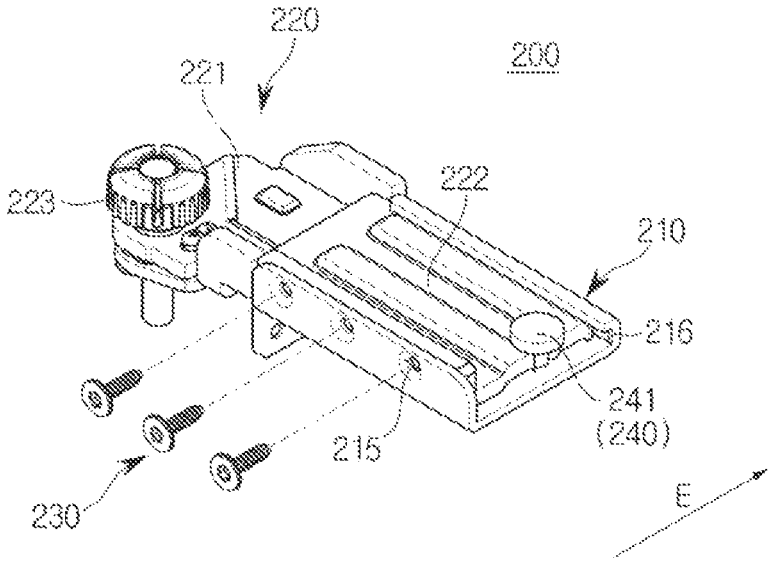

[Fig. 11e]
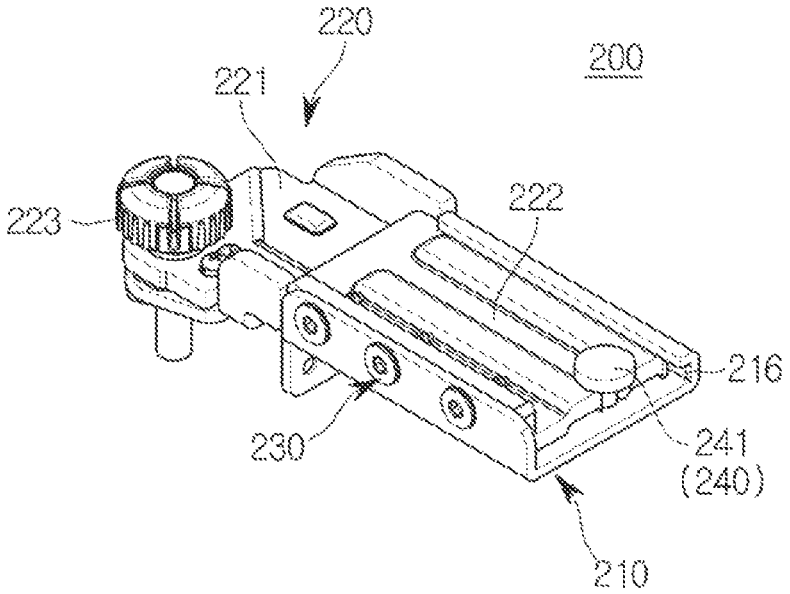
[Fig. 12]
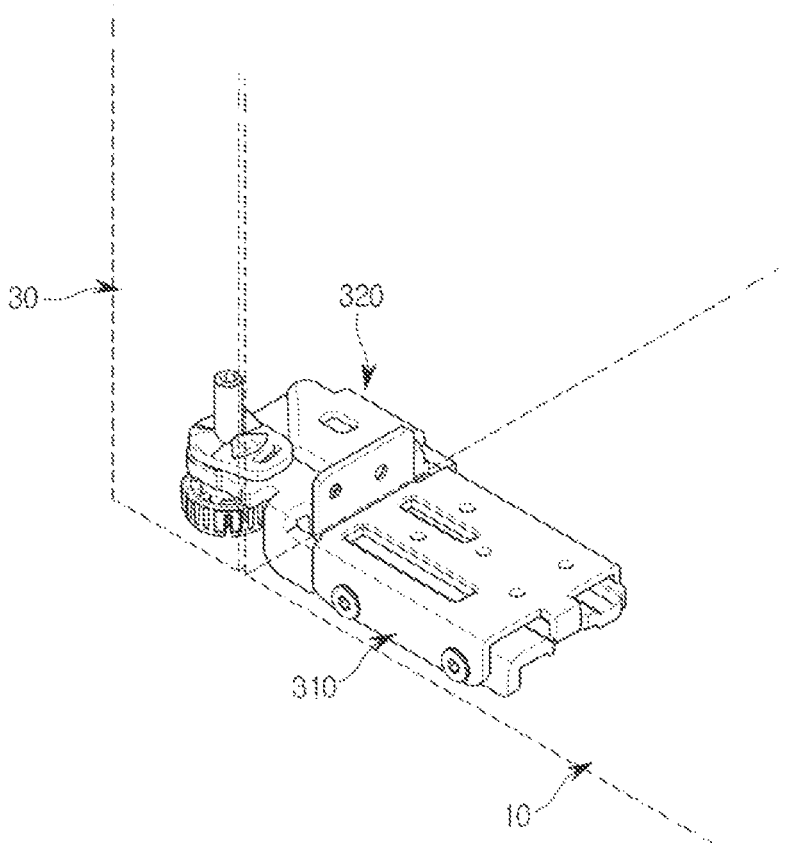

[Fig. 13]
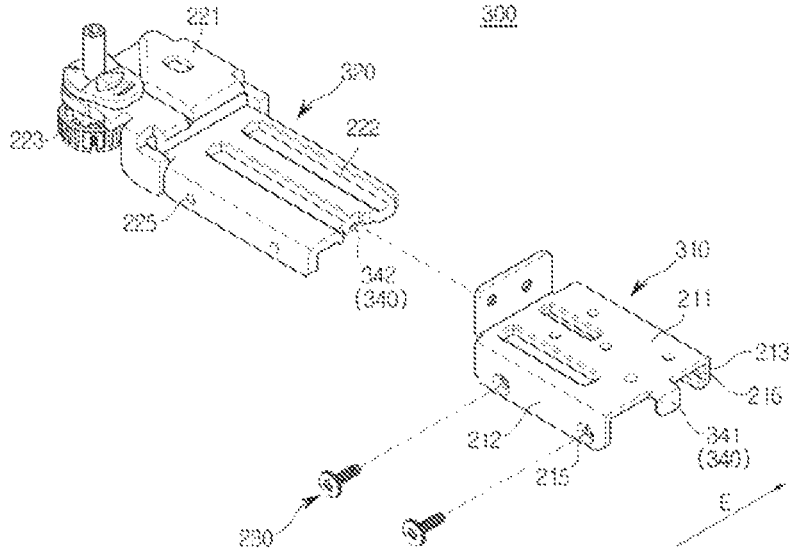
[Fig. 14a]
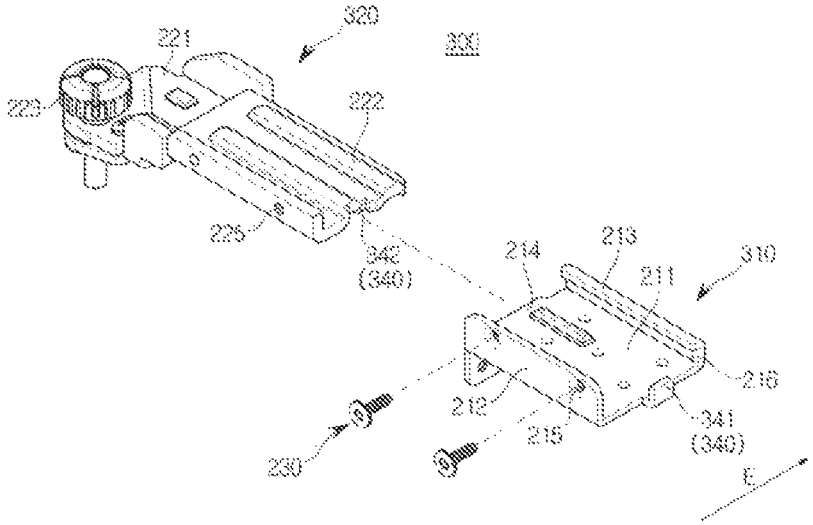

[Fig. 14b]
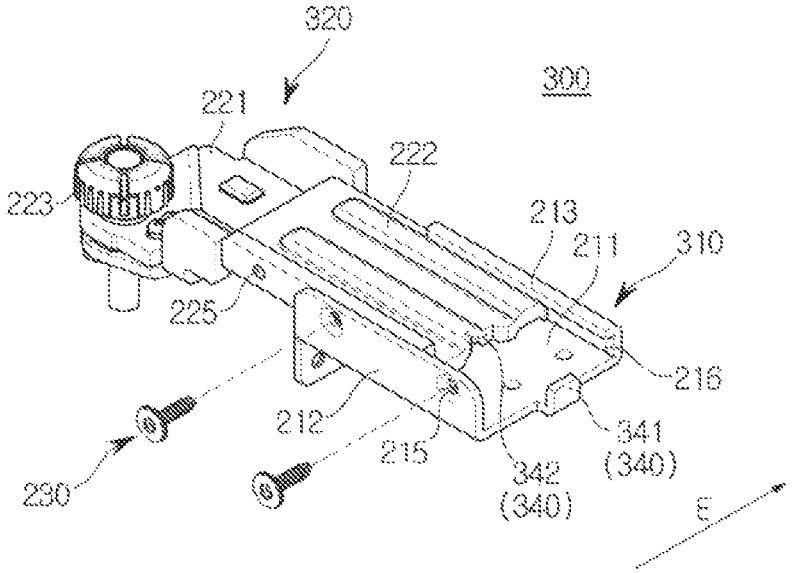
[Fig. 14c]
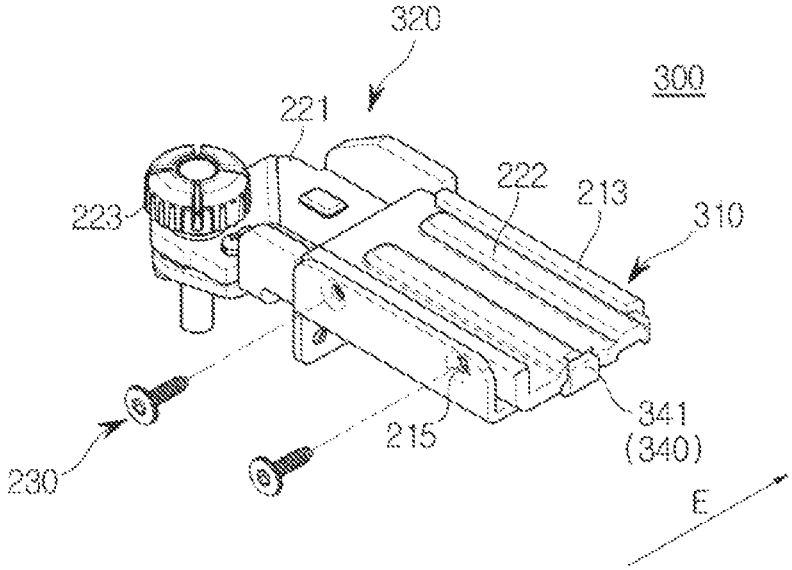

[Fig. 14d]
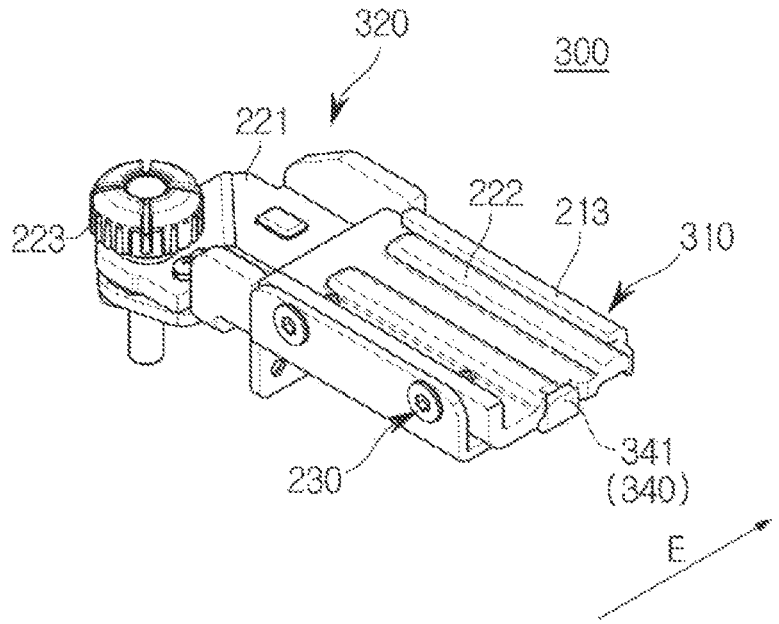
[Fig. 15]
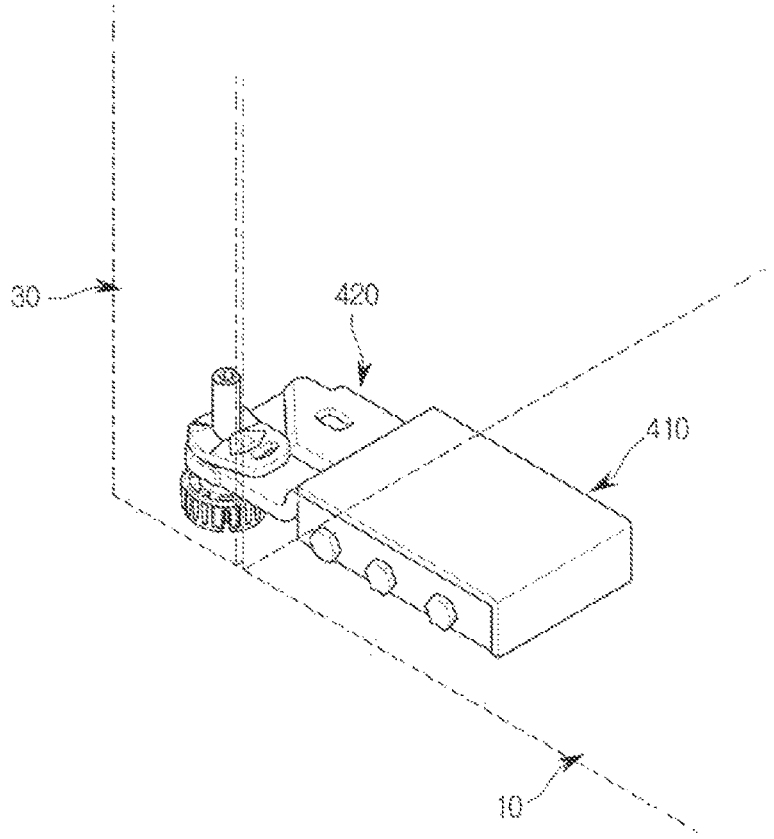

[Fig. 16]
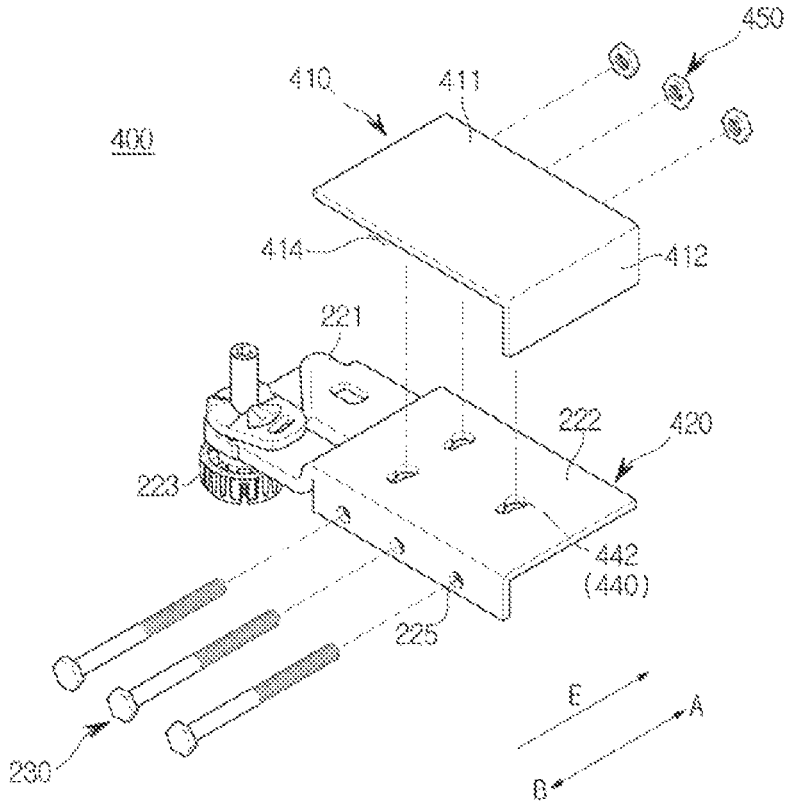

[Fig. 17a]
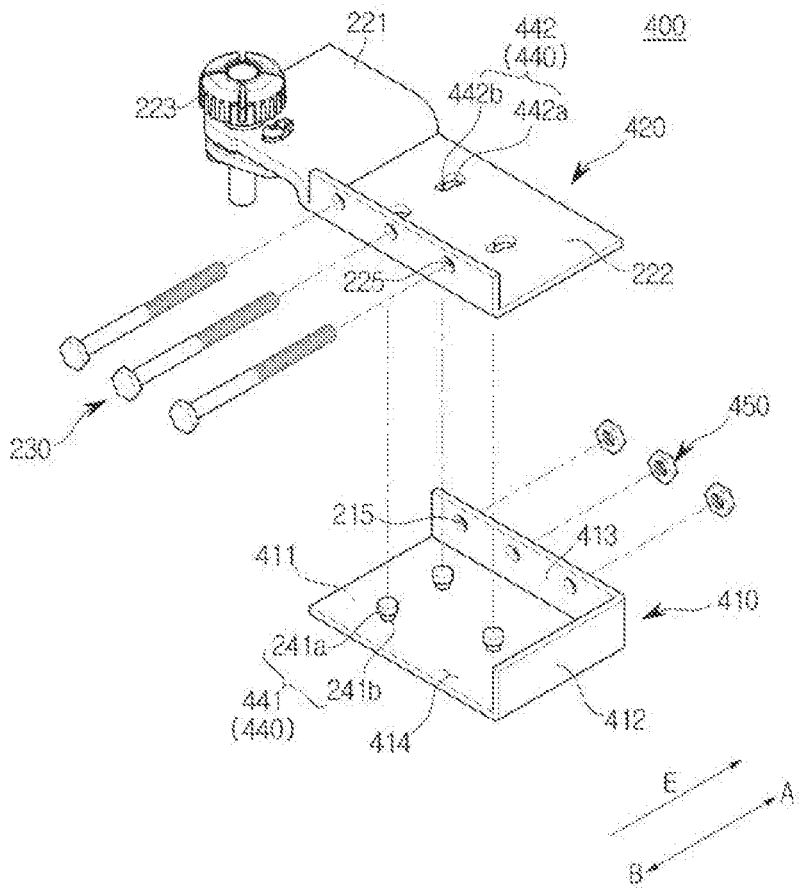
[Fig. 17b]
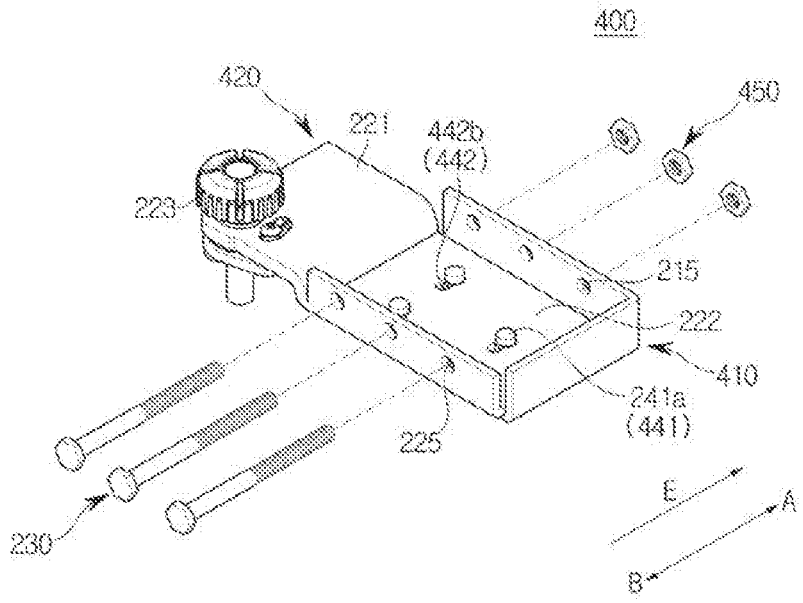

[Fig. 17c]
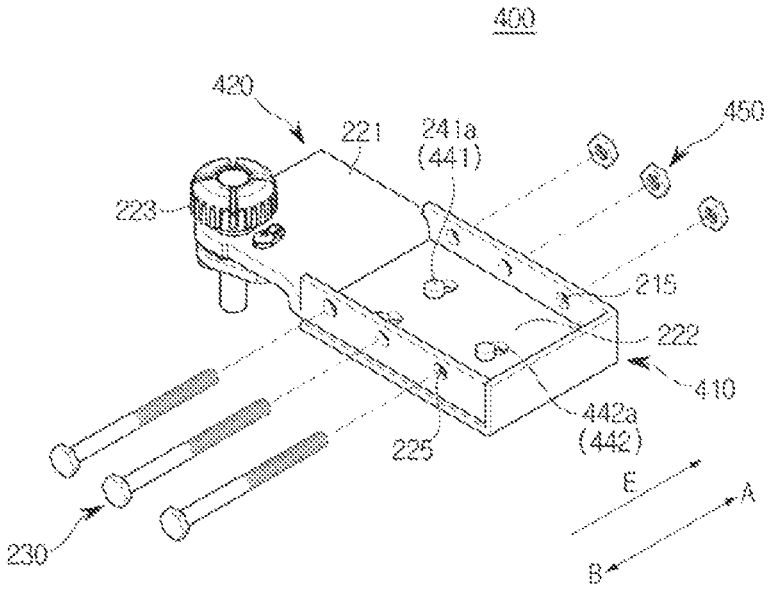
[Fig. 17d]
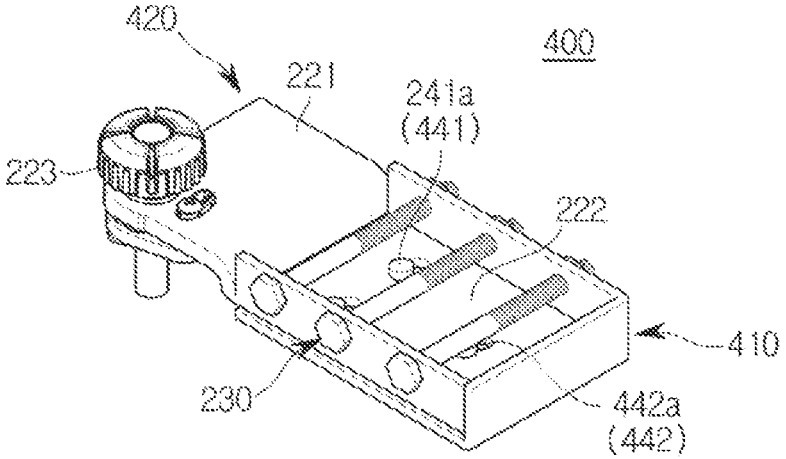

REFRIGERATOR

CROSS-REFERENCE TO RELATED APPLICATIONS

This application is a U.S. national stage application of International Application No. PCT/KR2014/011445 filed Nov. 26, 2014, and claims the priority benefit of Korean Application No. 10-2013-0145018, filed Nov. 27, 2013, in the Korean Intellectual Property Office, the disclosures of which are incorporated herein by reference.

TECHNICAL FIELD

The present invention relates to a refrigerator, and more particularly, to a refrigerator that has an improved structure to facilitate assembling a door and a main body which are separable from each other.

BACKGROUND ART

Generally, a refrigerator is an apparatus that includes a main body that forms an exterior appearance of the refrigerator, a storage compartment that is provided inside the main body in such a manner that a front surface of the storage compartment is open, and a cool air supplying apparatus that supplies the storage compartment with cool air, and keeps food fresh.

The open front surface of the storage compartment of the refrigerator is normally closed by a door in order to maintain the temperature of the storage compartment. The door is hinge-coupled to the main body and mounted to the main body in a selectively rotatable manner.

When the door and the main body need to be separated in a refrigerator installation process, a hinge device provided in each of upper and lower portions of the refrigerator should be disassembled. In this instance, in order to disassemble the hinge device provided in the lower portion of the refrigerator, a bolt provided in the bottom surface of the main body should be removed so as to fix the hinge device so that discomfort such that the refrigerator should be laid on its side is created.

DISCLOSURE

Technical Problem

The present invention is directed to providing a refrigerator in which a door and a main body can be separated in a state in which the refrigerator stands upright, thereby having an improved structure to improve the ease of installation of the refrigerator.

The present invention is also directed to providing a refrigerator which has an improved structure to improve the durability of a separable hinge bracket.

Technical Solution

One aspect of the present invention provides a refrigerator including: a main body that forms an exterior appearance; a storage compartment that is provided inside the main body; a door that is rotatably coupled to the main body so as to open and close an open front surface of the storage compartment; and a hinge bracket that connects the main body and the door, wherein the hinge bracket includes a first bracket that is coupled to the main body and a second bracket that is coupled to the door and detachably coupled to the first bracket.

Here, the second bracket may be detachably coupled to the first bracket in forward and backward directions.

Also, the second bracket may be slidably coupled to the first bracket.

Also, the second bracket may be slidably coupled to an inner side of the first bracket, and the hinge bracket may further include a coupling member that couples the second bracket to at least one surface of the first bracket.

Also, the hinge bracket may further include a fixing unit that fixes positions of the first bracket and the second bracket so that the first bracket and the second bracket are connectable with each other by the coupling member.

Also, the fixing unit may include a fixing guide that is provided in any one of the first bracket and the second bracket, and a fixing groove that is provided in the other one of the first bracket and the second bracket so that the fixing guide is fastened to the fixing groove.

Also, the first bracket may include a body that is disposed so as to face the main body, and a plurality of legs that form an opening open toward a front side of the first bracket together with the body so that the second bracket is inserted into the opening.

Also, the hinge bracket may further include a coupling member that couples the first bracket and the second bracket to each other, and the plurality of legs may include a first leg in which a first coupling hole to which the coupling member is coupled is formed.

Also, the plurality of legs may further include a second leg that faces the first leg and in which a guide unit for guiding movement of the second bracket is formed.

Also, the guide unit may be recessed on an inner wall of the second leg.

Also, a second coupling hole corresponding to the first coupling hole may be formed in one surface of the second bracket facing the first leg, and the first bracket and the second bracket may be coupled to each other by the coupling member passing through the first coupling hole and the second coupling hole.

Also, the hinge bracket may further include a fixing unit that fixes the second bracket to the first bracket so that the first coupling hole and the second coupling hole are positioned on a straight line in a coupling direction of the coupling member.

Also, the fixing unit may include a fixing guide that is provided in any one of the body and one surface of the second bracket facing the body, and a fixing groove that is provided in the other one of the body and one surface of the second bracket facing the body so as to be coupled to the fixing guide.

Also, the fixing guide may have a shape that extends from the body toward a rear side of the first bracket and is bent.

Also, the fixing guide may have a pin shape that protrudes from the body toward a lower side of the first bracket.

Also, the fixing guide may include a head, and a neck that has a smaller width than that of the head so as to be fastened to the fixing groove, and connects the head and the body.

Another aspect of the present invention provides a refrigerator including: a main body that forms an exterior appearance; a storage compartment that is provided inside the main body; a door that is rotatably coupled to the main body so as to open and close an open front surface of the storage compartment; and a hinge bracket that connects the main body and the door, wherein the hinge bracket includes a first bracket that is coupled to the main body, a second bracket that is coupled to the door so as to be positioned in front of the first bracket, and a connection member of which one end is coupled to the first bracket and the other end is detachably coupled to the second bracket so as to connect the first bracket and the second bracket.

Here, the connection member may include a body that is coupled to a fastening hole formed in a front surface of the first bracket, and a head that extends from the body toward a front side of the first bracket and has a different width from that of the body.

Also, the body and the head may have different shapes from each other.

Also, a connection member through-hole corresponding to the connection member may be formed in one surface of the second bracket facing the fastening hole, so that the second bracket is detachably coupled to the connection member.

Also, the connection member through-hole may include a fastening unit that has a shape corresponding to the head so that the head passes through the fastening unit toward a front side of the second bracket, and a locking unit that grasps and fixes an outer surface of the body so as to prevent the connection member from being separated from the connection member through-hole.

Also, the locking unit may have a shape corresponding to the body.

Also, when the second bracket is moved in a first direction in a state in which the head passes through the fastening unit, the head may protrude toward a front side of the locking unit and the body may be coupled to the locking unit.

Also, when the second bracket is moved in a second direction, the body may be separated from the locking unit, and the head may be positioned on a straight line with the fastening unit so that the second bracket is separable from the connection member.

Still another aspect of the present invention provides a refrigerator including: a main body that forms an exterior appearance; a storage compartment that is provided inside the main body; a door that is rotatably coupled to the main body so as to open and close an open front surface of the storage compartment; and a hinge bracket that connects the main body and the door, wherein the hinge bracket includes a first bracket that has a side opening open toward an outside of the main body and is provided so as to be coupled to the main body, and a second bracket that is coupled to the door and detachably coupled to the first bracket in a bilaterally separable manner.

Here, the first bracket may be coupled to a lower side of the main body, and the second bracket may be coupled to a lower side of the door so as to correspond to the first bracket.

Also, the second bracket may be slidably coupled to the first bracket in a direction from the side opening toward the inside of the main body.

Also, the hinge bracket may further include a coupling member that passes through the first bracket and the second bracket and couple the first bracket and the second bracket to each other, and a coupling direction of the coupling member with respect to the first bracket and the second bracket may coincide with a coupling direction of the second bracket with respect to the first bracket.

Also, the hinge bracket may further include a coupling member that couples the first bracket and the second bracket to each other.

Also, the coupling member may pass through the first bracket and the second bracket and couple the first bracket and the second bracket to each other.

Also, the coupling member may pass through one surface of the first bracket positioned on a downstream side in a coupling direction of the coupling member and one surface of the second bracket positioned on an upstream side in the coupling direction of the coupling member.

Also, the hinge bracket may further include a fixing unit that fixes positions of the first bracket and the second bracket so that the first bracket and the second bracket are connectable with each other by the coupling member.

Also, the fixing unit may include a fixing guide that is provided in any one of the first bracket and the second bracket, and a fixing groove that is provided in the other one of the first bracket and the second bracket so that the fixing guide is fastened to the fixing groove.

Also, the fixing guide may include a head, and a neck that connects any one of the first bracket and the second bracket and the head, and has a smaller width than that of the head.

Also, the fixing groove may include a fastening unit that is provided so that the head passes through the fastening unit, and a locking unit that is coupled to the neck and fixes the fixing guide to the fixing groove, and is connected to the fastening unit.

Also, when the second bracket is slid in the coupling direction of the coupling member in a state in which the head passes through the fastening unit, the second bracket may be fixed to the first bracket by coupling between the neck and the locking unit.

Advantageous Effects

According to embodiments of the present invention, a hinge bracket installed in a lower portion of a refrigerator may be constituted of a first bracket coupled to a main body and a second bracket coupled to a door which are separable from each other, and therefore the door and the main body can be easily separated in a state in which the refrigerator stands upright, thereby improving the ease of installation of the refrigerator.

Also, according to embodiments of the present invention, one or more connection members installed in the first bracket and one or more coupling members passing through the first bracket and the second bracket may be used in order to couple the first bracket and the second bracket which are separable from each other, and therefore it is possible to improve the durability of the hinge bracket constituted of the first bracket and the second bracket so that the first bracket and the second bracket which are installed in the lower portion of the refrigerator may stand the load of the door and the main body.

DESCRIPTION OF DRAWINGS

FIG. 1 is a perspective view showing the appearance of a refrigerator in accordance with one embodiment of the present invention;

FIG. 2 is a cross-sectional view showing a refrigerator in accordance with one embodiment of the present invention;

FIG. 3 is a perspective view showing a state in which a door of a refrigerator in accordance with one embodiment of the present invention is opened;

FIG. 4 is a perspective view showing a coupling relationship between a door and a main body of a refrigerator in accordance with one embodiment of the present invention;

FIG. 5 is an exploded perspective view showing a hinge bracket in accordance with a first embodiment in a refrigerator in accordance with one embodiment of the present invention;

FIG. 6 is a perspective view showing a state in which a coupling member of the hinge bracket in accordance with the first embodiment is separated in a refrigerator in accordance with one embodiment of the present invention;

FIG. 7 is a perspective view showing a state in which a second bracket of the hinge bracket in accordance with the first embodiment is separated from a first bracket in a refrigerator in accordance with one embodiment of the present invention;

FIG. 8 is a perspective view showing a state in which the second bracket of the hinge bracket in accordance with the first embodiment has been separated from the first bracket in a refrigerator in accordance with one embodiment of the present invention;

FIG. 9 is a perspective view showing a hinge bracket in accordance with a second embodiment in a refrigerator in accordance with one embodiment of the present invention;

FIG. 10 is an exploded perspective view showing the hinge bracket in accordance with the second embodiment in a refrigerator in accordance with one embodiment of the present invention;

FIGS. 11A to 11E are bottom perspective views showing a process in which a second bracket of the hinge bracket in accordance with the second embodiment is coupled to a first bracket in a refrigerator in accordance with one embodiment of the present invention;

FIG. 12 is a perspective view showing a hinge bracket in accordance with a third embodiment in a refrigerator in accordance with one embodiment of the present invention;

FIG. 13 is an exploded perspective view showing the hinge bracket in accordance with the third embodiment in a refrigerator in accordance with one embodiment of the present invention;

FIGS. 14A to 14D are bottom perspective views showing a process in which a second bracket of the hinge bracket in accordance with the third embodiment is coupled to a first bracket in a refrigerator in accordance with one embodiment of the present invention;

FIG. 15 is a perspective view showing a hinge bracket in accordance with a fourth embodiment in a refrigerator in accordance with one embodiment of the present invention;

FIG. 16 is an exploded perspective view showing the hinge bracket in accordance with the fourth embodiment in a refrigerator in accordance with one embodiment of the present invention; and FIGS. 17A to 17D are bottom perspective views showing a process in which a second bracket of the hinge bracket in accordance with the fourth embodiment is coupled to a first bracket in a refrigerator in accordance with one embodiment of the present invention.

MODES OF THE INVENTION

Hereinafter, a preferred embodiment of the present invention will be described in detail with reference to the accompanying drawings. Moreover, terms used in the description below such as "distal end", "rear end", "upper portion", "lower portion", "top", "bottom", and the like are defined on the basis of the drawings, and the shape and position of each component is not limited by these terms.

FIG. 1 is a perspective view showing an exterior appearance of a refrigerator in accordance with one embodiment of the present invention, FIG. 2 is a cross-sectional view showing a refrigerator in accordance with one embodiment of the present invention, FIG. 3 is a perspective view showing a state in which a door of a refrigerator in accordance with one embodiment of the present invention is opened, and FIG. 4 is a perspective view showing a coupling relationship between a door and a main body of a refrigerator in accordance with one embodiment of the present invention.

As shown in FIGS. 1 to 4, a refrigerator 1 includes a main body 10 that forms an exterior appearance, a storage compartment 20 that is provided in the main body 10 to have an open front surface, a door 30 that opens and closes the storage compartment 20, and a hinge module 40 that includes an upper hinge 41 and a lower hinge 43 to allow the door 30 to be rotatably coupled to the main body 10.

Specifically, the upper hinge 41 and the lower hinge 43 are fixed on both upper and lower end portions of the main body 10 and provide a rotation center axis for opening and closing the door 30. A hinge pin (not shown) of the upper hinge 41 is inserted into a pin insertion hole (not shown) formed in a top corner portion of the door 30 and acts as a rotary shaft at the time of opening and closing operations of the door 30. A hinge pin 43*a* of the lower hinge 43 is inserted into a pin insertion hole 43*b* formed in a bottom corner portion of the door 30 and acts as a rotary shaft at the time of opening and closing operations of the door 30 together with the hinge pin of the upper hinge 41. The hinge pin 43*a* of the lower hinge 43 passes through a pin coupling hole 44 formed in a second bracket 120 (see FIG. 5) coupled to the lower end portion of the door 30, and coupled to the pin insertion hole 43*b* formed in the bottom corner portion of the door 30. Accordingly, a user may open and close the storage compartment 20 using a door handle 50 provided in a front surface of the door 30.

The main body 10 includes an inner case 11 that forms the storage compartment 20, an outer case 13 that forms the exterior appearance, and a cool air supplying apparatus that supplies the storage compartment 20 with cool air.

The cool air supplying apparatus includes a compressor C, a condenser (not shown), an expansion valve (not shown), an evaporator 26, a blower fan 27, and the like, and a heat insulating material 15 is foamed between the inner case 11 and the outer case 13 of the main body 10 to prevent cool air of the storage compartment 20 from being discharged.

A machine room 23 is provided at a lower rear portion of the body 10 such that the compressor C for compressing a refrigerant and the condenser for condensing the compressed refrigerant are installed therein.

A refrigerator compartment 21 and a freezer compartment 22 are respectively opened and closed by a refrigerator door 31 and a freezer door 33 which are rotatably coupled to the body 10, and a plurality of door guards 35 to accommodate food are provided at rear surfaces of the refrigerator door 21 and the freezer door 33.

A plurality of shelves 24 are provided in the storage compartment 20 to divide the storage compartment 20 into a plurality of sections, and articles such as food may be loaded on the shelves 24.

In addition, a plurality of storage boxes 25 are provided to be taken in and out of the storage compartment 20 in a slidable manner.

A foaming space S is provided between the inner case 11 that forms the storage compartment 20 and the outer case 13 coupled to the outer side of the inner case 11 to form the exterior appearance, and the heat insulating material 15 is filled inside the foaming space S.

In order to enhance the heat insulating property of the heat insulating material 15, a vacuum insulation panel (VIP) (not shown) may be filled together with the heat insulating material 15.

FIG. 5 is an exploded perspective view showing a hinge bracket in accordance with a first embodiment in a refrigerator in accordance with one embodiment of the present invention. A second coupling member 160 may be used with the same meaning as a coupling member. In addition, at least one of the upper hinge 41 and the lower hinge 43 may have a type of a hinge bracket 100 in accordance with the first embodiment of the present invention. Specifically, in a process of transporting or installing the refrigerator 1, there is a case in which the door 30 should be separated from the main body 10. In this instance, the upper hinge 41 and the lower hinge 43 should be respectively separated, and in particular, when the lower hinge 43 is separated, the main body 10 of the refrigerator 1 should be laid on its side or a separate tool is required. In order to solve this inconvenience, the hinge bracket 100 in accordance with the first embodiment of the present invention may be in a more preferable form at the lower hinge 43. Therefore, hereinafter, the hinge bracket 100 that is used at the lower hinge 43 will be the focus of the description.

As shown in FIG. 5, the hinge bracket 100 connecting the door 30 and the main body 10 may include a first bracket 110 and a second bracket 120.

The first bracket 110 is coupled to a bottom surface of the main body 10. One or more insertion holes 113 are formed in a bottom surface 112 of the first bracket 110 facing the bottom surface of the main body 10, and the first bracket 110 is fixed to the bottom surface of the main body 10 by one or more first coupling members 150 passing through the one or more insertion holes 113. One or more fastening holes 114 and one or more first fixing holes 115 may be formed in a front surface 111 of the first bracket 110 toward the front, and a description thereof will be made later.

The second bracket 120 may be coupled to a bottom surface of the door 30, and detachably coupled to the front side of the first bracket 110. One or more connection members 130 connecting the first bracket 110 and the second bracket 120 may be installed in the first bracket 110. The one or more connection members 130 are coupled to the one or more fastening holes 114 which are formed in the front surface 111 of the first bracket 110 so as to correspond to the one or more connection members 130.

Specifically, the one or more connection members 130 may include a body 131 and a head 132. The body 131 is coupled to the one or more fastening holes 114 so as to face the rear of the first bracket 110, and the head 132 extends from the body 131 so as to face the front of the first bracket 110. The one or more connection members 130 are coupled to the one or more fastening holes 114 in such a manner that the head 132 protrudes toward the front of the first bracket 110. The head 132 may protrude toward the outside of the body 131 so as to have a larger diameter than the diameter of the body 131.

The one or more connection members 130 may be formed integrally with the first bracket 110 in such a manner that the head 132 protrudes toward the front of the first bracket 110.

One or more stoppers 140 may be provided in the first bracket 110. The one or more stoppers 140 may be provided behind the one or more fastening holes 114 so as to support the one or more connection members 130 passing through the one or more fastening holes 114. The one or more stoppers 140 may be coupled to a recessed portion (not shown) formed on the bottom surface 112 of the first bracket 110, and have a shape protruding toward the lower side of the main body 10. The one or more stoppers 140 may face one end of the body 131 of the one or more connection members 130 passing through the one or more fastening holes 114.

One or more connection member through-holes 122 corresponding to the one or more connection members 130 may be formed in a rear surface 121 of the second bracket 120 facing the front surface 111 of the first bracket 110 in such a manner that the second bracket 120 is detachably coupled to the one or more connection members 130.

The one or more connection member through-holes 122 may include a fastening unit 123 and a locking unit 124.

The fastening unit 123 and the locking unit 124 may have different diameters from each other. Specifically, the fastening unit 123 may have a larger diameter than that of the head 132 so that the head 132 may be coupled to or separated from the fastening unit 123, and the locking unit 124 may have a smaller diameter than that of the head 132 so as to prevent the head 132 from being separated from the one or more connection member through-holes 122. The fastening unit 123 and the locking unit 124 may be connected to each other so that the one or more connection members 130 can be moved between the fastening unit 123 and the locking unit 124. The body 131 is coupled to the locking unit 124 so that the one or more connection members 130 are fixed to the one or more connection member through-holes 122.

In addition, the fastening unit 123 and the locking unit 124 may have different shapes from each other. The fastening unit 123 may have a shape corresponding to the head 132 so that the head 132 can pass through the fastening unit 123 toward the front of the second bracket 120, and the locking unit 124 may have a shape corresponding to the body 131 so as to grasp and fix the outer surface of the body 131. The fastening unit 123 has a larger width than that of the locking unit 124 coupled to the body 131 so that the head 132 having a larger width than that of the body 131 can pass through the fastening unit 123.

One or more second fixing holes 126 corresponding to the one or more first fixing holes 115 provided in the front surface 111 of the first bracket 110 may be formed in the rear surface 121 of the second bracket 120 facing the one or more fastening holes 114. The second bracket 120 may be coupled to the front surface 111 of the first bracket 110 so as to face the rear of the first bracket 110 by the second coupling member 160 passing through the one or more second fixing holes 126 and the one or more first fixing holes 115 so that the binding force between the first bracket 110 and the second bracket 120 caused by the one or more connection members 130 may be complemented.

The first coupling member 150 and the second coupling member 160 may include bolts.

FIG. 6 is a perspective view showing a state in which a coupling member of the hinge bracket in accordance with the first embodiment is separated in a refrigerator in accordance with one embodiment of the present invention, FIG. 7 is a perspective view showing a state in which a second bracket of the hinge bracket in accordance with the first embodiment is separated from a first bracket in a refrigerator in accordance with one embodiment of the present invention, and FIG. 8 is a perspective view showing a state in which the second bracket of the hinge bracket in accordance with the first embodiment has been separated from the first bracket in a refrigerator in accordance with one embodiment of the present invention. Unillustrated reference numerals refer to FIGS. 1 to 5.

As shown in FIGS. 6 to 8, a process in which the second bracket 120 is coupled to the first bracket 110 is as follows.

The second bracket 120 is disposed in front of the first bracket 110 so that the one or more connection member through-holes 122 may face the one or more connection members 130. The second bracket 120 is made to approach the front surface 111 of the first bracket 110 so that the head 132 of the one or more connection members 130 can pass through the fastening unit 123 of the one or more connection member through-holes 122. When the head 132 passes through the fastening unit 123, the second bracket 120 is slid in a first direction A. When the second bracket 120 is slid in the first direction A, the head 132 is positioned in front of the locking unit 124, and one end of the body 131 extending from the head 132 is coupled to the locking unit 124 so that the second bracket 120 is coupled to the first bracket 110. In order to enhance the binding force between the first bracket 110 and the second bracket 120, the second coupling member 160 sequentially passing through the second fixing hole 126 and the first fixing hole 115 is coupled to the second bracket 120 and the first bracket 110.

As shown in FIGS. 6 to 8, a process in which the second bracket 120 is separated from the first bracket 110 is as follows.

The second coupling member 160 that has sequentially passed through the second fixing hole 126 and the first fixing hole 115 toward the rear of the first bracket 110 so as to connect the first bracket 110 and the second bracket 120 is removed. When the second bracket 120 is slid in a second direction B, the head 132 is positioned in front of the fastening unit 123 and the body 131 is spaced apart from the locking unit 124. In this case, the one or more connection members 130 are positioned on a straight line with the fastening unit 123. When the second bracket 120 is moved toward the front of the second bracket 120, the second bracket 120 is separated from the first bracket 110 while the one or more connection members 130 are spaced apart from the one or more fastening holes 114.

The first direction A and the second direction B are opposite to each other.

FIG. 9 is a perspective view showing a hinge bracket in accordance with a second embodiment in a refrigerator in accordance with one embodiment of the present invention, and FIG. 10 is an exploded perspective view showing the hinge bracket in accordance with the second embodiment in a refrigerator in accordance with one embodiment of the present invention. Hereinafter, unillustrated reference numerals refer to FIGS. 1 to 4. In addition, at least one of the upper hinge 41 and the lower hinge 43 may have a form of a hinge bracket 200 in accordance with the second embodiment. Specifically, in a process of transporting or installing the refrigerator 1, there is a case in which the door 30 should be separated from the main body 10. In this instance, the upper hinge 41 and the lower hinge 43 should be respectively separated, and in particular, when the lower hinge 43 is separated, the main body 10 of the refrigerator 1 should be laid on its side or a separate tool is required. In order to solve this inconvenience, the hinge bracket 200 in accordance with the second embodiment of the present invention may be in a more preferable form at the lower hinge 43. Therefore, hereinafter, the hinge bracket 200 that is used at the lower hinge 43 will be the focus of the description.

As shown in FIGS. 9 and 10, the hinge bracket 200 connecting the door 30 and the main body 10 may include a first bracket 210 and a second bracket 220.

The first bracket 210 may be coupled to the main body 10. Specifically, the first bracket 210 may be coupled to the bottom surface of the main body 10.

The first bracket 210 may include a body 211. The body 211 may be disposed so as to face the main body 10, that is, the bottom surface of the main body 10. The body 211 may be fixedly coupled to the main body 10.

The first bracket 210 may further include a plurality of legs 212 and 213. The plurality of legs 212 and 213 may form an opening 214 (see FIG. 11A) that is open toward the front of the first bracket 210 together with the body 211 so that the second bracket 220 can be inserted into the plurality of legs 212 and 213.

The plurality of legs 212 and 213 may include a first leg 212 and a second leg 213. The first leg 212 may be connected to the body 211 in such a manner to face outside of the main body 10. The second leg 213 may be connected to the body 211 in such a manner to face inside of the main body 10. A first coupling hole 215 to which a coupling member 230 is coupled may be formed in the first leg 212. In this instance, one or more first coupling holes 215 may be formed in the first leg 212. The second leg 213 may face the first leg 212. In addition, a guide unit 216 for guiding the movement of the second bracket 220 may be formed in the second leg 213. The guide unit 216 may be recessed on the inner wall of the second leg 213. As an example, when the first bracket 210 is cut along I-I', the guide unit 216 may have a cross-section of "⊃"-shape that is open toward the inside of the first bracket 210 (see FIG. 10). In addition, the guide unit 216 may serve to fix the positions of the first bracket 210 and the second bracket 220 so that the first bracket 210 and the second bracket 220 are connectable with each other by the coupling member 230 together with a fixing unit 240.

The second bracket 220 may be coupled to the door 30. Specifically, the second bracket 220 may be coupled to the bottom surface of the door 30.

The second bracket 220 may be detachably coupled to the first bracket 210.

The second bracket 220 may be detachably coupled to the first bracket 210 in forward and backward directions.

The second bracket 220 may be slidably coupled to the first bracket 210. As an example, the second bracket 220 may be slidably coupled to the inner side of the first bracket 210. The second bracket 220 may be inserted into the opening 214 of the first bracket 210 and moved toward the rear of the main body 10 along the guide unit 216. In this instance, the fixing unit 240 may serve as a stopper that limits the movement of the second bracket 220 facing the rear of the main body 10.

The second bracket 220 may include a first portion 221 and a second portion 222.

The first portion 221 may face the door 30. An adjustment portion 223 for adjusting the height or level of the refrigerator 1 may be installed in the first portion 221. The height or level of the refrigerator 1 may be adjusted by rotating the adjustment portion 223. As an example, when the adjustment portion 223 is rotated in the clockwise direction, the height of the refrigerator 1 may be increased. When the adjustment portion 223 is rotated in the counterclockwise direction, the height of the refrigerator 1 may be reduced. A method of adjusting the height or level of the refrigerator 1 is not limited thereto, and may be variously modified. The adjustment portion 223 may connect the second bracket 220 and the door 30.

The second portion 222 may extend from the first portion 221 toward the main body 10. The second portion 222 may be coupled to the first bracket 210. Specifically, the second portion 222 may be inserted into the opening 214 of the first bracket 210 and moved toward the rear of the main body 10 along the guide unit 216. When the second bracket 220 is coupled to the first bracket 210, the first portion 221 of the second bracket 220 may be positioned in front of the first bracket 210, and the second portion 222 of the second bracket 220 may be positioned inside the first bracket 210.

A second coupling hole 225 may be formed in one surface of the second bracket 220. Specifically, the second coupling hole 225 corresponding to a first coupling hole 215 may be formed in the one surface of the second bracket 220 facing the first leg 212. In other words, the second coupling hole 225 may be formed in one surface of the second portion 222 facing the first leg 212. The shape and number of the second coupling holes 225 may correspond to the shape and number of the first coupling holes 215. In addition, the shape and number of the first coupling holes 215 and the second coupling holes 225 may correspond to the shape and number of the coupling members 230.

The hinge bracket 200 may further include the coupling member 230 for allowing the first bracket 210 and the second bracket 220 to be coupled to each other. The coupling member 230 may allow the second bracket 220 to be coupled to one or more surfaces of the first bracket 210. By way of an example, the coupling member 230 may allow the one surface of the second bracket 220 facing the first leg 212 to be coupled to the first leg 212. Specifically, the first bracket 210 and the second bracket 220 may be coupled to each other by the coupling member 230 passing through the first coupling hole 215 and the second coupling hole 225. In other words, when the door 30 is coupled to the main body 10, the one surface of the second bracket 220 may be coupled to the first leg 212 of the first bracket 210 by the coupling member 230, and the other surface of the second bracket 220 may be coupled to the guide unit 216 of the first bracket 210. In addition, a fixing guide 241 may be coupled to a fixing groove 242. In this manner, in a process in which the first bracket 210 and the second bracket 220 are coupled to each other, the coupling member 230 may be used only when one surface of the first bracket 210 and the one surface of the second bracket 220 are coupled to each other, and therefore it is possible to reduce the number of the coupling numbers 230 which is required in the process in which the first bracket 210 and the second bracket 220 are coupled to each other. Consequently, coupling between the one surface of the first bracket 210 and the one surface of the second bracket 220 by the coupling member 230 may lead to material cost savings.

The number and shape of the coupling members 230 may be variously modified.

The hinge bracket 200 may further include the fixing unit 240.

The fixing unit 240 may serve to fix the positions of the first bracket 210 and the second bracket 220 so that the first bracket 210 and the second bracket 220 are connectable with each other by the coupling member 230. Specifically, the fixing unit 240 may serve to fix the second bracket 220 to the first bracket 210 so that the first coupling hole 215 of the first bracket 210 and the second coupling hole 225 of the second bracket 220 are positioned on a straight line in a coupling direction E of the coupling member 230.

The fixing unit 240 may include the fixing guide 241 and the fixing groove 242.

The fixing guide 241 may be provided in any one of the first bracket 210 and the second bracket 220. The fixing groove 242 may be provided in the other one of the first bracket 210 and the second bracket 220 so as to be coupled to the fixing guide 241. Specifically, the fixing guide 241 may be provided in any one of the body 211 of the first bracket 210 and one surface of the second bracket 220 facing the body 211. The fixing groove 242 may be provided in the other one of the body 211 of the first bracket 210 and the one surface of the second bracket 220 facing the body 211 so as to be coupled to the fixing guide 241. Preferably, the fixing guide 241 may be provided in the body 211 of the first bracket 210 so as to be positioned between the first leg 212 and the second leg 213. The fixing guide 241 may be provided in the body 211 of the first bracket 210 so as to protrude toward the same direction as a direction in which the plurality of legs 212 and 213 extend from the body 211. Preferably, the fixing groove 242 may be provided on the one surface of the second bracket 220 facing the body 211 so as to be coupled to the fixing guide 241. The fixing groove 242 may be provided in the rear of the second portion 222. The fixing groove 242 may have a shape recessed toward the inside of the second bracket 220.

The fixing guide 241 may have a pin shape that protrudes from the body 211 toward the lower side of the first bracket 210. In other words, the fixing guide 241 may have the pin shape that protrudes from the body 211 toward the same direction as the direction in which the plurality of legs 212 and 213 extend from the body 211.

The fixing guide 241 may have a head 241*a* and a neck 241*b*.

The head 241*a* and the neck 241*b* may have different widths from each other. Specifically, the neck 241*b* may have a smaller width than that of the head 241*a* so as to be fastened to the fixing groove 242.

The neck 241*b* may connect the head 241*a* and the body 211 of the first bracket 210. The fixing groove 242 may have a smaller width than that of the head 241*a*. When the neck 241*b* is coupled to the fixing groove 242, the head 241*a* may serve to support a peripheral portion of the fixing groove 242.

Prior to the coupling between the first bracket 210 and the second bracket 220 by the coupling member 230, the fixing unit 240 may serve to primarily fix the positions of the first bracket 210 and the second bracket 220 so that coupling between the first bracket 210 and the second bracket 220 is facilitated. In addition, the guide unit 216 of the first bracket 210 may serve to guide an insertion position of the second bracket 220 with respect to the first bracket 210. That is, the fixing unit 240 and the guide unit 216 of the first bracket 210 may reduce the number of coupling members 230 which is required in a coupling process of the first bracket 210 and the second bracket 220. In addition, the fixing unit 240 and the guide unit 216 of the first bracket 210 may primarily fix the positions of the first bracket 210 and the second bracket 220 so that coupling between the first bracket 210 and the second bracket 220 is accurately carried out by the coupling member 230, and therefore it is possible to enhance the binding force of the first bracket 210 and the second bracket 220.

FIGS. 11A to 11E are bottom perspective views showing a process in which a second bracket of the hinge bracket in accordance with the second embodiment is coupled to a first bracket in a refrigerator in accordance with one embodiment of the present invention. Hereinafter, unillustrated reference numerals refer to FIGS. 1 to 4, and FIGS. 9 and 10.

As shown in FIGS. 11A to 11E, a process in which the second bracket 220 is coupled to the first bracket 210 is as follows.

The second bracket 220 is disposed in front of the first bracket 210 so that the second portion 222 of the second bracket 220 faces the opening 214 of the first bracket 210. The second bracket 220 is made to approach the front surface of the first bracket 210 so that the second portion 222 is inserted into the opening 214 of the first bracket 210. When the second portion 222 of the second bracket 220 is inserted into the opening 214 of the first bracket 210, the second bracket 220 is slid toward the rear of the main body 10. The second bracket 220 is slid toward the rear of the main body 10 in a state in which one surface of the second bracket 220 is fitted into the guide unit 216 of the first bracket 210. The movement of the second bracket 220 toward the rear of the main body 10 is limited by the fixing unit 240. That is, the movement of the second bracket 220 is limited by coupling of the fixing guide 241 to the fixing groove 242. In this instance, the first bracket 210 and the second bracket 220 are connectable with each other by the coupling member 230. Specifically, the first coupling hole 215 of the first bracket 210 and the second coupling hole 225 of the second bracket 220 are positioned on a straight line in the coupling direction E of the coupling member 230. The coupling member 230 sequentially passes through the first coupling hole 215 and the second coupling hole 225 and thereby the first bracket 210 and the second bracket 220 are coupled to each other. The door 30 is rotatably coupled to the main body 10 by coupling between the first bracket 210 and the second bracket 220.

A process in which the second bracket 220 is separated from the first bracket 210 is as follows.

The coupling member 230 that connects the first bracket 210 and the second bracket 220 while sequentially passing through the first coupling hole 215 and the second coupling hole 225 is removed. The second bracket 220 is slid toward the front of the main body 10. The second bracket 220 is slid toward the front of the main body 10 in a state in which one surface of the second bracket 220 is fitted into the guide unit 216 of the first bracket 210. In this instance, the fixing groove 242 is separated from the fixing guide 241. The second portion 222 of the second bracket 220 is spaced apart from the opening 214 of the first bracket 210 toward the front of the main body 10, and therefore the second bracket 220 is separated from the first bracket 210. The door 30 may be separated from the main body 10 by separation between the first bracket 210 and the second bracket 220.

FIG. 12 is a perspective view showing a hinge bracket in accordance with a third embodiment in a refrigerator in accordance with one embodiment of the present invention, and FIG. 13 is an exploded perspective view showing the hinge bracket in accordance with the third embodiment in a refrigerator in accordance with one embodiment of the present invention. Hereinafter, unillustrated reference numerals refer to FIGS. 1 to 4. In addition, at least one of the upper hinge 41 and the lower hinge 43 may have a form of a hinge bracket 300 in accordance with the third embodiment of the present invention. Specifically, in a process of transporting or installing the refrigerator 1, there is a case in which the door 30 should be separated from the main body 10. In this instance, the upper hinge 41 and the lower hinge 43 should be respectively separated, and in particular, when the lower hinge 43 is separated, the main body 10 of the refrigerator 1 should be laid on its side or a separate tool is required. In order to solve this inconvenience, the hinge bracket 300 in accordance with the third embodiment of the present invention may be in a more preferable form at the lower hinge 43. Therefore, hereinafter, the hinge bracket 300 that is used at the lower hinge 43 will be the focus of the description. Hereinafter, repeated descriptions in FIGS. 9 to 11E will be omitted.

As shown in FIGS. 12 and 13, the hinge bracket 300 connecting the door 30 and the main body 10 may include a first bracket 310 and a second bracket 320. Descriptions of the first bracket 310 and the second bracket 320 are the same as those in FIGS. 9 to 11E, and therefore will be omitted.

The hinge bracket 300 may further include the coupling member 230 for allowing the first bracket 310 and the second bracket 320 to be coupled to each other. Description of the coupling member 230 is the same as that in FIGS. 9 to 11E, and therefore will be omitted.

The hinge bracket 300 may further include a fixing unit 340.

The fixing unit 340 may serve to fix the positions of the first bracket 310 and the second bracket 320 so that the first bracket 310 and the second bracket 320 are connectable with each other by the coupling member 230. Specifically, the fixing unit 340 may serve to fix the second bracket 320 to the first bracket 310 so that the first coupling hole 215 of the first bracket 310 and the second coupling hole 225 of the second bracket 320 are positioned on a straight line in the coupling direction E of the coupling member 230.

The fixing unit 340 may include a fixing guide 341 and a fixing groove 342.

The fixing guide 341 may be provided in any one of the first bracket 310 and the second bracket 320. The fixing groove 342 may be provided in the other one of the first bracket 310 and the second bracket 320 so as to be coupled to the fixing guide 341. Specifically, the fixing guide 341 may be provided in any one of the body 211 of the first bracket 310 and one surface of the second bracket 320 facing the body 211. The fixing groove 342 may be provided in the other one of the body 211 of the first bracket 310 and the one surface of the second bracket 320 facing the body 211 so as to be coupled to the fixing guide 341. Preferably, the fixing guide 341 may be provided in the body 211 of the first bracket 310 so as to be positioned between the first leg 212 and the second leg 213. Preferably, the fixing groove 342 may be provided on the one surface of the second bracket 320 facing the body 211 so as to be coupled to the fixing guide 341. The fixing groove 342 may be provided in the rear of the second portion 222. The fixing groove 342 may have a shape recessed toward the inside of the second bracket 320.

The fixing guide 341 may have a shape that extends from the body 211 toward the rear of the first bracket 310 and is bent. Specifically, the fixing guide 341 may have the shape that extends from the body 211 toward the rear of the first bracket 310 and is bent toward the same direction as the direction in which the plurality of legs 212 and 213 extend from the body 211. That is, the fixing guide 341 may have the shape that extends from the body 211 toward the rear of the first bracket 340 and is bent toward the lower side of the first bracket 340.

The shapes of the fixing guide 341 and the fixing groove 342 may be variously modified.

The fixing guide 341 may be fitted into and coupled to the fixing groove 342, but a coupling method between the fixing guide 341 and the fixing groove 342 is not limited thereto.

Prior to the coupling between the first bracket 310 and the second bracket 320 by the coupling member 230, the fixing unit 340 may serve to primarily fix the positions of the first bracket 310 and the second bracket 320 so that coupling between the first bracket 310 and the second bracket 320 is facilitated. In addition, the guide unit 216 of the first bracket 310 may serve to guide an insertion position of the second bracket 320 with respect to the first bracket 310. That is, the fixing unit 340 and the guide unit 216 of the first bracket 310 may reduce the number of coupling members 230 which are required in a coupling process of the first bracket 310 and the second bracket 320. In addition, the fixing unit 340 and the guide unit 216 of the first bracket 310 may primarily fix the positions of the first bracket 310 and the second bracket 320 so that coupling between the first bracket 310 and the second bracket 320 is accurately carried out by the coupling member 230, and therefore it is possible to enhance the binding force of the first bracket 310 and the second bracket 320.

FIGS. 14A to 14D are bottom perspective views showing a process in which a second bracket of the hinge bracket in accordance with the third embodiment is coupled to a first bracket in a refrigerator in accordance with one embodiment of the present invention. Hereinafter, unillustrated reference numerals refer to FIGS. 1 to 4 and FIGS. 12 and 13.

As shown in FIGS. 14A to 14D, a process in which the second bracket 320 is coupled to the first bracket 310 is as follows.

The second bracket 320 is disposed in front of the first bracket 310 so that the second portion 222 of the second bracket 320 may face the opening 214 of the first bracket 310. The second bracket 320 is made to approach the front surface of the first bracket 310 so that the second portion 222 of the second bracket 320 is inserted into the opening 214 of the first bracket 310. When the second portion 222 of the second bracket 220 is inserted into the opening 214 of the first bracket 310, the second bracket 320 is slid toward the rear of the main body 10. The second bracket 320 is slid toward the rear of the main body 10 in a state in which one surface of the second bracket 320 is fitted into the guide unit 216 of the first bracket 310. The movement of the second bracket 320 toward the rear of the main body 10 is limited by the fixing unit 340. That is, the movement of the second bracket 320 is limited by coupling of the fixing guide 341 to the fixing groove 342. In this instance, the first bracket 310 and the second bracket 320 are connectable with each other by the coupling member 230. Specifically, the first coupling hole 215 of the first bracket 310 and the second coupling hole 225 of the second bracket 320 are positioned on a straight line in the coupling direction E of the coupling member 230. The coupling member 230 sequentially passes through the first coupling hole 215 and the second coupling hole 225 and thereby the first bracket 310 and the second bracket 320 are coupled to each other. The door 30 may be rotatably coupled to the main body 10 by coupling between the first bracket 310 and the second bracket 320.

A process in which the second bracket 320 is separated from the first bracket 310 is as follows.

The coupling member 230 that connects the first bracket 310 and the second bracket 320 while sequentially passing through the first coupling hole 215 and the second coupling hole 225 is removed. The second bracket 320 is slid toward the front of the main body 10. The second bracket 320 is slid toward the front of the main body 10 in a state in which the one surface of the second bracket 320 is fitted into the guide unit 216 of the first bracket 310. In this instance, the fixing groove 342 is separated from the fixing guide 341. The second portion 222 of the second bracket 320 is spaced apart from the opening 214 of the first bracket 310 toward the front of the main body 10, and therefore the second bracket 320 is separated from the first bracket 310. The door 30 may be separated from the main body 10 by separation between the first bracket 310 and the second bracket 320.

FIG. 15 is a perspective view showing a hinge bracket in accordance with a fourth embodiment in a refrigerator in accordance with one embodiment of the present invention, and FIG. 16 is an exploded perspective view showing the hinge bracket in accordance with the fourth embodiment in a refrigerator in accordance with one embodiment of the present invention. Hereinafter, unillustrated reference numerals refer to FIGS. 1 to 4. In addition, at least one of the upper hinge 41 and the lower hinge 43 may have a form of a hinge bracket 400 in accordance with the fourth embodiment of the present invention. Specifically, in a process of transporting or installing the refrigerator 1, there is a case in which the door 30 should be separated from the main body 10. In this instance, the upper hinge 41 and the lower hinge 43 should be respectively separated, and in particular, when the lower hinge 43 is separated, the main body 10 of the refrigerator 1 should be laid on its side or a separate tool is required. In order to solve this inconvenience, the hinge bracket 400 in accordance with the fourth embodiment of the present invention may be in a more preferable form at the lower hinge 43. Therefore, hereinafter, the hinge bracket 400 that is used at the lower hinge 43 will be the focus of the description.

As shown in FIGS. 15 and 16, the hinge bracket 400 connecting the door 30 and the main body 10 may include a first bracket 410 and a second bracket 420. The first bracket 410 may be coupled to the main body 10. Specifically, the first bracket 410 may be coupled to the lower side of the main body 10.

The first bracket 410 may include frames 411, 412, and 413 that form an exterior appearance. The frames 411, 412, and 413 may include a top frame 411 forming a top surface of the first bracket 410, a rear frame 412 forming a rear surface of the first bracket 410, and a side frame 413 (see FIG. 17A) forming one side surface of the first bracket 410. The top frame 411 may face the lower side of the main body 10, that is, the bottom surface of the main body 10. A first coupling hole 215 to which the coupling member 230 is coupled may be formed in the side frame 413.

The first bracket 410 may further include a side opening 414. The side opening 414 may face the side frame 413. The side opening 414 may be open toward the outside of the main body 10. In other words, the side opening 414 may be provided in the first bracket 410 toward the outside of the main body 10, and the side frame 413 may be provided in the first bracket 410 toward the inside of the main body 10.

The second bracket 420 may be coupled to the door 30. Specifically, the second bracket 420 may be coupled to the lower side of the door 30 so as to correspond to the first bracket 410.

The second bracket 420 may be detachably coupled to the first bracket 410.

The second bracket 420 may be detachably coupled to the first bracket 410 in left and right directions.

The second bracket 420 may be slidably coupled to the first bracket 410. By way of an example, the second bracket 420 may be slidably coupled to the inner side of the first bracket 410. The second bracket 420 may be slidably coupled to the first bracket 410 in a direction from the side opening 414 to the inside of the main body 10. In other words, the second bracket 420 may be slidably coupled to the first bracket 410 in a direction from the side opening 414 to the side frame 413.

The second bracket 420 may include the first portion 221 and the second portion 222.

The first portion 221 may face the door 30. The adjustment portion 223 for adjusting the height or level of the refrigerator 1 may be installed in the first portion 221. The height or level of the refrigerator 1 may be adjusted by rotating the adjustment portion 223. As an example, when the adjustment portion 223 is rotated in the clockwise direction, the height of the refrigerator 1 may be increased. When the adjustment portion 223 is rotated in the counterclockwise direction, the height of the refrigerator 1 may be reduced. A method of adjusting the height or level of the refrigerator 1 is not limited thereto, and may be variously modified. The adjustment portion 223 may connect the second bracket 420 and the door 30.

The second portion 222 may extend from the first portion 221 toward the main body 10. The second portion 222 may be coupled to the first bracket 410. Specifically, the second portion 222 may be inserted into the side opening 414 of the first bracket 410 and moved toward the inside of the main body 10. When the second bracket 420 is coupled to the first bracket 410, the first portion 221 of the second bracket 420 may be positioned in front of the first bracket 410, and the second portion 222 of the second bracket 420 may be positioned inside the first bracket 410.

The second coupling hole 225 may be formed in one surface of the second bracket 420. Specifically, the second coupling hole 225 corresponding to the first coupling hole 215 may be formed in one surface of the second bracket 420 facing the side opening 414. In other words, the second coupling hole 225 may be formed in the one surface of the second portion 222 facing the side opening 414. The shape and number of the second coupling holes 225 may correspond to the shape and number of the first coupling holes 215. In addition, the shape and number of the first coupling holes 215 and the second coupling holes 225 may correspond to the shape and number of the coupling members 230.

The hinge bracket 300 may further include the coupling member 230 for allowing the first bracket 410 and the second bracket 420 to be coupled to each other. The coupling member 230 may couple the first bracket 410 and the second bracket 420 to other by passing through the first bracket 410 and the second bracket 420. A coupling direction E of the coupling member 230 with respect to the first bracket 410 and the second bracket 420 may coincide with a coupling direction of the second bracket 420 with respect to the first bracket 410.

The coupling member 230 may pass through one surface of the first bracket 410 positioned on a downstream side in the coupling direction E of the coupling member 230 and one surface of the second bracket 420 positioned on an upstream side in the coupling direction E of the coupling member 230. In other words, the coupling member 230 may pass through the side frame 413 of the first bracket 410 and the one surface of the second bracket 420 facing the side opening 414 of the first bracket 410. In this manner, in a process in which the first bracket 410 and the second bracket 420 are coupled to each other, it is possible to further enhance the binding force between the first bracket 410 and the second bracket 420 using the coupling member 230 passing through the first bracket 410 and the second bracket 420. In addition, when using the coupling member 230 passing through the first bracket 410 and the second bracket 420 in the process in which the first bracket 410 and the second bracket 420 are coupled to each other, the load of the main body 10 and the door 30 of the refrigerator 1 may be distributed to the first bracket 410, the second bracket 420, and the coupling member 230, and therefore it is possible to improve the durability of the hinge bracket 400. The coupling member 230 that sequentially passes through the second coupling hole 225 of the second bracket 420 and the first coupling hole 215 of the first bracket 410 may be coupled to a fastening member 450. As an example, the coupling member 230 may correspond to a bolt and the fastening member 450 may correspond to a nut.

The number and shape of the coupling members 230 may be variously modified.

The hinge bracket 400 may further include a fixing unit 440.

The fixing unit 440 may serve to fix the positions of the first bracket 410 and the second bracket 420 so that the first bracket 410 and the second bracket 420 are connectable with each other by the coupling member 230. Specifically, the fixing unit 440 may serve to fix the second bracket 420 to the first bracket 410 so that the first coupling hole 215 of the first bracket 410 and the second coupling hole 225 of the second bracket 420 are positioned on a straight line in the coupling direction E of the coupling member 230.

The fixing unit 440 may include a fixing guide 441 and a fixing groove 442.

The fixing guide 441 may be provided in any one of the first bracket 410 and the second bracket 420. The fixing groove 442 may be provided in the other one of the first bracket 410 and the second bracket 420 so that the fixing guide 441 may be fastened to the fixing groove 442. Specifically, the fixing guide 441 may be provided in any one of the top frame 411 of the first bracket 410 and one surface of the second bracket 420 facing the top frame 411. The fixing groove 442 may be provided in the other one of the top frame 411 of the first bracket 410 and the one surface of the second bracket 420 facing the top frame 411 so as to be coupled to the fixing guide 441. Preferably, the fixing guide 441 may be provided in the top frame 411 of the first bracket 410. The fixing guide 441 may be provided in the top frame 411 of the first bracket 410 so as to protrude toward the same direction as a direction in which the rear frame 412 and the side frame 413 extend from the top frame 411. Preferably, the fixing groove 442 may be provided on the one surface of the second bracket 420 facing the top frame 411 so as to be coupled to the fixing guide 441. The fixing groove 442 may be provided in the second portion 222 of the second bracket 420 facing the top frame 411.

The fixing guide 441 may have a pin shape that protrudes from the top frame 411 toward the lower side of the first bracket 410. In other words, the fixing guide 441 may have the pin shape that protrudes from the top frame 411 so as to face the same direction as the direction in which the rear frame 412 and the side frame 413 extend from the top frame 411.

The fixing guide 411 may include a head 241*a* and a neck 241*b*.

The head 241*a* and the neck 241*b* may have different widths from each other. Specifically, the neck 241*b* may have a smaller width than that of the head 241*a*.

The neck 241*b* may connect any one of the first bracket 410 and the second bracket 420 and the head 241*a*. Preferably, the neck 241*b* may connect the top frame 411 of the first bracket 410 and the head 241*a*.

The fixing groove 442 may include a fastening unit 442*a* and a locking unit 442*b*.

The fastening unit 442*a* may be provided in such a manner that the head 241*a* may pass through the fastening unit 442*a*. The locking unit 442*b* may be coupled to the neck 241*b* so that the fixing guide 441 may be fixed to the fixing groove 442 and connected to the fastening unit 442*a*.

The fastening unit 442*a* and the locking unit 442*b* may have different widths from each other. Specifically, the fastening unit 442*a* may have a larger width than that of the head 241*a* in such a manner that the head 241*a* may be coupled to or separated from the fastening unit 442*a*, and the locking unit 442*b* may have a smaller width than that of the head 241*a* so as to prevent the head 241*a* from being separated from the fixing groove 442. The fastening unit 442*a* and the locking unit 442*b* may be connected to each other in such a manner that the fixing guide 441 may be moved between the fastening unit 442*a* and the locking unit 442*b*. The neck 241*b* of the fixing guide 441 may be coupled to the locking unit 442*b* so that the fixing guide 441 may be fixed to the fixing groove 442.

In addition, the fastening unit 442*a* and the locking unit 442*b* may have different shapes from each other. The fastening unit 442*a* may have a shape corresponding to the head 241*a* so that the head 241*a* may pass through the fastening unit 442*a*. The locking unit 442*b* may have a shape corresponding to the neck 241*b* so as to grasp and fix the outer surface of the neck 241*b*. The fastening unit 442*a* may have a larger width than that of the locking unit 442*b* coupled to the neck 241*b* in such a manner that the head 241*a* having a larger width than that of the neck 241*b* may pass through the fastening unit 442*a*.

When the second bracket 420 is slid in the coupling direction E of the coupling member 230 in a state in which the head 241*a* passes through the fastening unit 442*a*, the second bracket 420 may be fixed to the first bracket 410 by coupling between the neck 241*b* and the locking unit 442*b*.

Prior to coupling between the first bracket 410 and the second bracket 420 by the coupling member 230, the fixing unit 440 may serve to primarily fix the positions of the first bracket 410 and the second bracket 420 so that the coupling between the first bracket 410 and the second bracket 420 is facilitated. Accordingly, the fixing unit 440 may primarily fix the positions of the first bracket 410 and the second bracket 420 so that the coupling between the first bracket 410 and the second bracket 420 is accurately carried out by the coupling member 230, and therefore it is possible to enhance the binding force of the first bracket 410 and the second bracket 420.

FIGS. 17A to 17D are bottom perspective views showing a process in which a second bracket of the hinge bracket in accordance with the fourth embodiment in a refrigerator in accordance with one embodiment of the present invention. Hereinafter, unillustrated reference numerals refer to FIGS. 1 to 4 and FIGS. 15 and 16.

As shown in FIGS. 17A to 17D, a process in which the second bracket 420 is coupled to the first bracket 410 is as follows.

The second bracket 420 is made to approach the first bracket 410 so that the fixing groove 442 and the fixing guide 441 face each other. In other words, the second bracket 420 is made to approach the first bracket 410 so that the second portion 222 of the second bracket 420 faces the top frame 411 of the first bracket 410. When the head 241*a* of the fixing guide 441 passes through the fastening unit 442*a* of the fixing groove 442, the second bracket 420 is slid in the first direction A. When the second bracket 420 is slid in the first direction A, the head 241*a* is positioned on a lower side of the locking unit 442*b*, and the neck 241*b* connected to the head 241*a* is coupled to the locking unit 442*b*, and therefore the second bracket 420 is fixed to the first bracket 410. In this instance, the first bracket 410 and the second bracket 420 may be connectable with each other by the coupling member 230. Specifically, the first coupling hole 215 of the first bracket 410 and the second coupling hole 225 of the second bracket 420 are positioned on a straight line in the coupling direction E of the coupling member 230. The coupling member 230 sequentially passes through the second coupling hole 225 and the first coupling hole 215 and thereby the first bracket 410 and the second bracket 420 are coupled to each other. The coupling member 230 that has sequentially passed through the second coupling hole 225 and the first coupling hole 215 is coupled to the fastening member 450. The door 30 may be rotatably coupled to the main body 10 by coupling between the first bracket 410 and the second bracket 420.

A process in which the second bracket 420 is separated from the first bracket 410 is as follows.

The fastening member 450 is separated from the coupling member 230. Next, the coupling member 230 that has sequentially passed through the second coupling hole 225 and the first coupling hole 215 is removed. When the second bracket 420 is slid in the second direction B, the head 241*a* is positioned on the lower side of the fastening unit 442*a*, and the neck 241*b* is spaced apart from the locking unit 442*b*. In this instance, the fixing guide 441 is positioned on a straight line with the fastening unit 442*a*. When the second bracket 420 is moved toward the lower side of the main body 10, the second bracket 420 is separated from the first bracket 410 while the fixing guide 441 is spaced apart from the fixing groove 442.

The first direction A and the second direction B may be opposite to each other. As an example, when the second bracket 420 is coupled to the first bracket 410 in a bilaterally separable manner, the first direction A indicates the right direction and the second direction B indicates the left direction.

Although a few embodiments of the present invention have been shown and described, it should be appreciated by those skilled in the art that changes may be made in these embodiments without departing from the principles and spirit of the invention, the scope of which is defined in the claims and their equivalents.

The invention claimed is:

1. A refrigerator comprising:

a main body that forms an exterior appearance;

a storage compartment that is provided inside the main body;

a door that is rotatably coupled to the main body so as to open and close an open front surface of the storage compartment; and a hinge bracket that connects the main body and the door, wherein the hinge bracket includes a first bracket that is coupled to the main body and that includes a body, a plurality of legs extended from the body to be spaced apart from each other, and a guide unit formed in one of the plurality of legs, and a second bracket that is coupled to the door and detachably coupled to the first bracket, wherein the second bracket is guided in a direction of insertion into the first bracket by the guide unit and slidably coupled to an inner side of the first bracket, and the hinge bracket further includes a coupling member that couples the second bracket to at least one surface of the first bracket, wherein the hinge bracket further includes a fixing unit that fixes positions of the first bracket and the second bracket for alignment so that the first bracket and the second bracket are connectable with each other by the coupling member, wherein the fixing unit includes a fixing guide that is provided in the body of the first bracket so as to protrude in a direction in which the plurality of legs extend from the body and perpendicular to the direction of insertion, and a fixing groove that is provided in a middle portion of an end of the second bracket and open to an outer perimeter of the end of the second bracket so that the fixing guide is fastened to the fixing groove when the fixing guide is inserted into the fixing groove in the direction of insertion, and wherein the body is disposed so as to face the main body, and the plurality of legs form an opening open toward a front side of the first bracket together with the body so that the second bracket is inserted into the opening.

2. The refrigerator according to claim 1, wherein the second bracket is detachably coupled to the first bracket in a direction perpendicular to an axis of rotation of the door.

3. The refrigerator according to claim 1, wherein the second bracket is slidably coupled to the first bracket.

4. The refrigerator according to claim 1, wherein the plurality of legs include a first leg in which a first coupling hole to which the coupling member is coupled is formed.

5. The refrigerator according to claim 4, wherein the plurality of legs further include a second leg that faces the first leg and in which the guide unit for guiding movement of the second bracket is formed.

6. The refrigerator according to claim 5, wherein the guide unit is recessed on an inner wall of the second leg.

7. The refrigerator according to claim 4, wherein a second coupling hole corresponding to the first coupling hole is formed in one surface of the second bracket facing the first leg, and the first bracket and the second bracket are coupled to each other by the coupling member passing through the first coupling hole and the second coupling hole.

8. The refrigerator according to claim 7, wherein the fixing unit fixes the second bracket to the first bracket for alignment so that the first coupling hole and the second coupling hole are positioned on a straight line in a coupling direction of the coupling member.

9. The refrigerator according to claim 1, wherein the fixing guide has a shape that extends from the body toward a rear side of the first bracket and is bent.

10. The refrigerator according to claim 1, wherein the fixing guide has a pin shape that protrudes from the body toward a lower side of the first bracket.

11. The refrigerator according to claim 10, wherein the fixing guide includes a head, and a neck that has a smaller width than that of the head so as to be inserted into the fixing groove, and connects the head and the body.

* * * * *